US010408557B2

(12) United States Patent
Verdino et al.

(10) Patent No.: US 10,408,557 B2
(45) Date of Patent: Sep. 10, 2019

(54) VEHICULAR TIRE DEFLATION DEVICE AND PROPULSION UNIT FOR VEHICULAR TIRE DEFLATION DEVICE

(71) Applicant: Stop Stick, Ltd., Cincinnati, OH (US)

(72) Inventors: Steven P. Verdino, Hamilton, OH (US); Andrew S. Morrison, Loveland, OH (US); Lawrence J. Kelly, Fairfield, OH (US); James P. Wersching, Cincinnati, OH (US)

(73) Assignee: Stop Stick, Ltd., Cincinnati, OH (US)

( * ) Notice: Subject to any disclaimer, the term of this patent is extended or adjusted under 35 U.S.C. 154(b) by 0 days.

(21) Appl. No.: 15/782,986

(22) Filed: Oct. 13, 2017

(65) Prior Publication Data

US 2018/0106572 A1 Apr. 19, 2018

Related U.S. Application Data

(60) Provisional application No. 62/407,919, filed on Oct. 13, 2016.

(51) Int. Cl.

| | |
|---|---|
| ***F41B 3/02*** | (2006.01) |
| ***B66D 1/74*** | (2006.01) |
| ***E01F 13/12*** | (2006.01) |
| ***F41H 11/10*** | (2006.01) |

(52) U.S. Cl.

CPC ..... *F41B 3/02* (2013.01); *B66D 1/7421* (2013.01); *E01F 13/12* (2013.01); *F41H 11/10* (2013.01); *B66D 2700/03* (2013.01)

(58) Field of Classification Search

CPC ..... E01F 13/12; E01F 13/00

See application file for complete search history.

(56) References Cited

U.S. PATENT DOCUMENTS

| | | | | |
|---|---|---|---|---|
| 1,075,377 | A | 10/1913 | Phillips | |
| 1,094,226 | A | 4/1914 | LeDuc | |
| 1,232,575 | A | 7/1917 | Lefort | |
| 1,276,100 | A | 8/1918 | Niznik | |
| 1,412,048 | A | 4/1922 | Ehringer | |
| 1,721,978 | A | 7/1929 | Sherwood | |
| 2,313,388 | A | 3/1943 | McDonald | |
| 2,325,260 | A | 7/1943 | May | |
| 2,346,713 | A | 4/1944 | Walker | |
| 2,353,386 | A | 7/1944 | Bourcier | |
| 2,438,563 | A | 3/1948 | Kollmeyer | |
| 2,746,571 | A | 5/1956 | Taylor | |
| 2,912,229 | A | 11/1959 | Persgard | |
| 3,289,939 | A | 12/1966 | Martinov | |
| 3,456,920 | A * | 7/1969 | Elvington | E01F 13/12 256/1 |
| 3,652,059 | A | 3/1972 | Groblebe | |
| 3,931,894 | A | 1/1976 | Murphy | |
| 3,993,167 | A | 11/1976 | Reed | |
| 4,096,782 | A | 6/1978 | Deschenes | |

(Continued)

FOREIGN PATENT DOCUMENTS

| | | |
|---|---|---|
| CH | 292008 | 7/1953 |

*Primary Examiner* — Abigail A Risic

(74) *Attorney, Agent, or Firm* — Ulmer & Berne LLP

(57) ABSTRACT

A propulsion unit includes a platform, a propulsion assembly, and a tether. The propulsion assembly facilitates selective launching of a tire deflation device from the platform. The tether is coupled to the platform and is configured for attachment to a deflation device.

12 Claims, 36 Drawing Sheets

(56) References Cited

U.S. PATENT DOCUMENTS 4,360,153 A 11/1982 Mantion et al.
4,382,714 A 5/1983 Hutchison
4,473,948 A 10/1984 Chadwick
4,500,225 A 2/1985 Quittner
4,544,303 A 10/1985 Glasmire
4,632,424 A 12/1986 Morris
4,795,093 A 1/1989 Kozelnicky
4,995,756 A 2/1991 Kilgrow et al.
5,058,843 A 10/1991 Koster
5,113,765 A 5/1992 Carey et al.
5,123,774 A 6/1992 Dubiel
5,253,950 A 10/1993 Kilgrow et al.
5,292,013 A 3/1994 Earl
5,322,385 A 6/1994 Reisman
5,330,285 A 7/1994 Greves et al.
5,443,225 A 8/1995 Tracy et al.
5,452,962 A 9/1995 Greves
5,482,397 A 1/1996 Soleau
5,498,102 A 3/1996 Bissell
5,507,588 A 4/1996 Marts et al.
5,536,109 A 7/1996 Lowndes
5,588,774 A * 12/1996 Behan ..... E01F 13/123 404/6
5,704,445 A * 1/1998 Jones ..... E01F 13/12 180/287
5,738,218 A 4/1998 Gonzales
5,820,293 A 10/1998 Groen et al.
5,890,832 A 4/1999 Soleau
6,024,510 A 2/2000 Kamienchick
6,045,293 A * 4/2000 Dickinson ..... E01F 13/123 256/1
6,155,745 A 12/2000 Groen et al.
6,187,328 B1 2/2001 Ballard et al.
6,474,903 B1 11/2002 Marts et al.
6,659,682 B2 * 12/2003 Heeks ..... E01F 9/529 404/15
6,758,628 B1 7/2004 Curry, Jr.
D503,645 S 4/2005 Wirth et al.
7,025,526 B2 4/2006 Blair
7,056,054 B1 6/2006 Keith et al.
7,118,305 B1 * 10/2006 Corbett ..... E01F 13/12 404/6
7,201,531 B2 4/2007 Shackelford et al.
7,244,075 B2 * 7/2007 Stadler ..... E01F 13/046 404/6
7,481,599 B2 * 1/2009 Stice ..... E01F 13/046 404/6
7,780,575 B1 8/2010 Goodwin, III et al.
8,132,980 B1 * 3/2012 Lee ..... E01F 13/12 180/287
8,231,303 B1 * 7/2012 Bowen ..... F41H 11/08 404/6
8,277,143 B2 * 10/2012 Adler ..... E01F 9/685 256/13.1
8,517,625 B2 * 8/2013 McCoy ..... E01F 13/12 404/6
8,622,650 B2 1/2014 Lifton
D710,233 S 8/2014 Wersching et al.
8,794,865 B2 * 8/2014 Stadler ..... E01F 13/046 404/6
8,858,113 B1 * 10/2014 Bettendorf ..... E01F 13/12 404/6
2005/0006505 A1 1/2005 McNeeley et al.
2005/0244223 A1 * 11/2005 Shackelford ..... E01F 13/12 404/6
2006/0104714 A1 * 5/2006 Keith ..... E01F 13/12 404/6
2007/0264079 A1 * 11/2007 Martinez ..... E01F 13/12 404/6
2007/0271859 A1 11/2007 Scheirs
2008/0264734 A1 10/2008 Walter
2010/0008720 A1 1/2010 Dhondy
2010/0166498 A1 * 7/2010 Adler ..... E01F 13/00 404/6
2011/0097147 A1 * 4/2011 Castro ..... E01F 13/12 404/6
2014/0119825 A1 * 5/2014 Castro ..... E01F 13/12 404/6
2014/0199118 A1 7/2014 Wersching et al.
2017/0183204 A1 * 6/2017 Zelinsky ..... E01F 13/12

* cited by examiner

VEHICULAR TIRE DEFLATION DEVICE AND PROPULSION UNIT FOR VEHICULAR TIRE DEFLATION DEVICE

REFERENCE TO RELATED APPLICATION

This application claims priority of U.S. provisional patent application Ser. No. 62/407,919, entitled Propulsion Unit for Vehicular Tire Deflation Devices, filed Oct. 13, 2016, and hereby incorporates this provisional patent application by reference herein in its entirety.

TECHNICAL FIELD

The apparatus and methods described below generally relate to a propulsion unit and/or a retraction unit for vehicular tire deflation devices.

BACKGROUND

Spike strips are oftentimes deployed manually on a roadway by law enforcement to disable a vehicle by puncturing the tires of the vehicle.

SUMMARY

In accordance with one embodiment, a propulsion unit for a tire deflation device is provided. The propulsion unit comprises a platform, a propulsion assembly, and a tether. The propulsion assembly is configured to facilitate selective launching of a tire deflation device from the platform. The tether is coupled to the platform and is configured for attachment to a tire deflation device.

In accordance with another embodiment, a kit comprises a plurality of tire deflation devices and a propulsion unit. The propulsion unit comprises a platform, a plurality of propulsion assemblies, and at least one tether. The platform defines a plurality of slots. Each propulsion assembly is associated with one of the slots and facilitates selective launching of one tire deflation device of the plurality of tire deflation devices from the platform. The at least one tether coupled to the platform and at least one tire deflation device of the plurality of tire deflation devices.

In accordance with yet another embodiment, a tire deflation device comprises a body and at least one internal spike. The body has an outer wall that defines an elongate a passageway. The at least one internal spike disposed between the outer wall and the passageway. The passageway is configured to facilitate routing of a tether of a propulsion unit therethrough.

BRIEF DESCRIPTION OF THE DRAWINGS

It is believed that certain embodiments will be better understood from the following description taken in conjunction with the accompanying drawings in which:

FIGS. 23-25A are various views depicting the propulsion unit of FIG. 18, with the spool removed for clarity of illustration;

DETAILED DESCRIPTION

Figure 1:
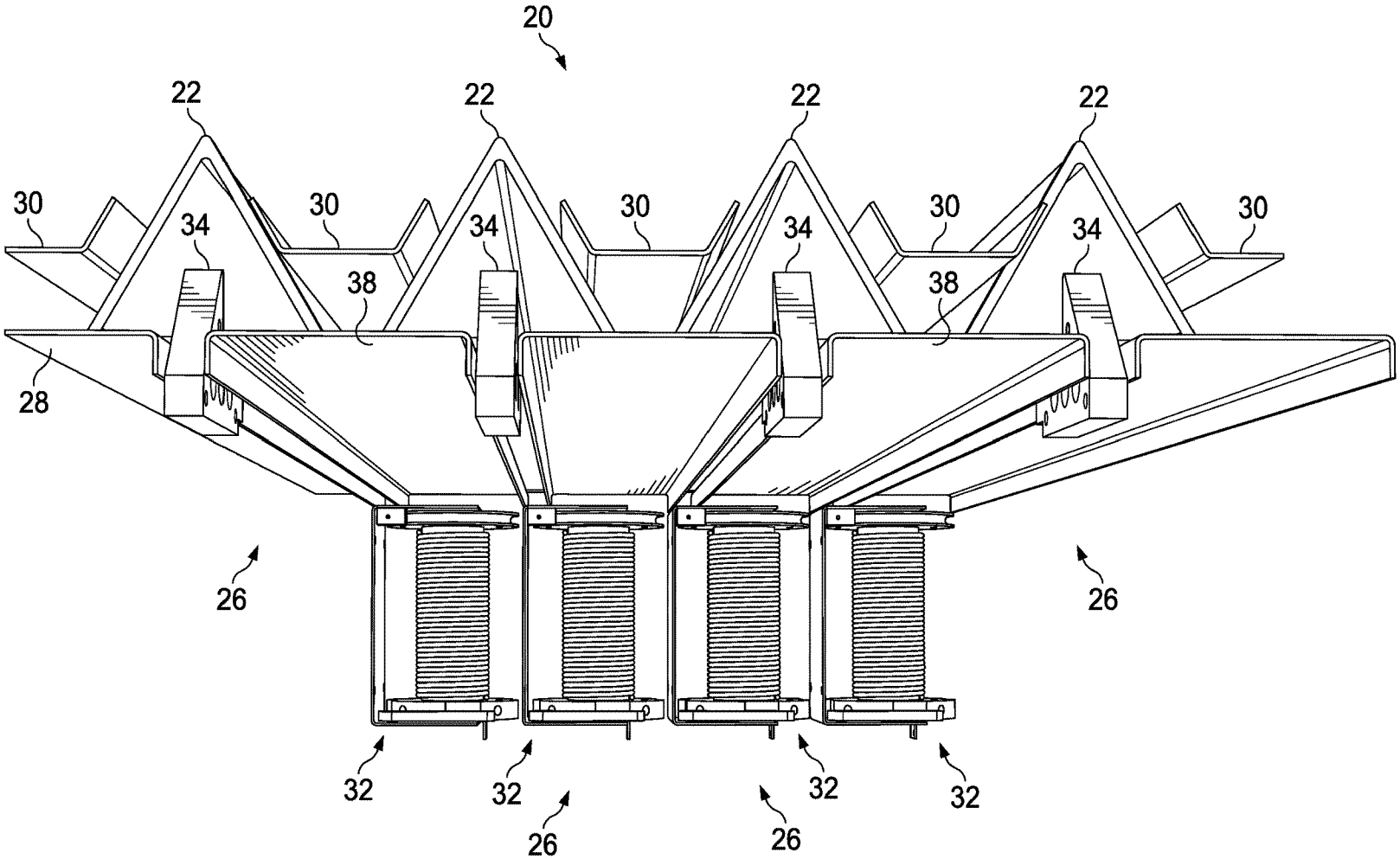
FIG. 1 is a rear isometric view depicting a propulsion unit and a plurality of deflation devices, in accordance with one embodiment.
Figure 2:
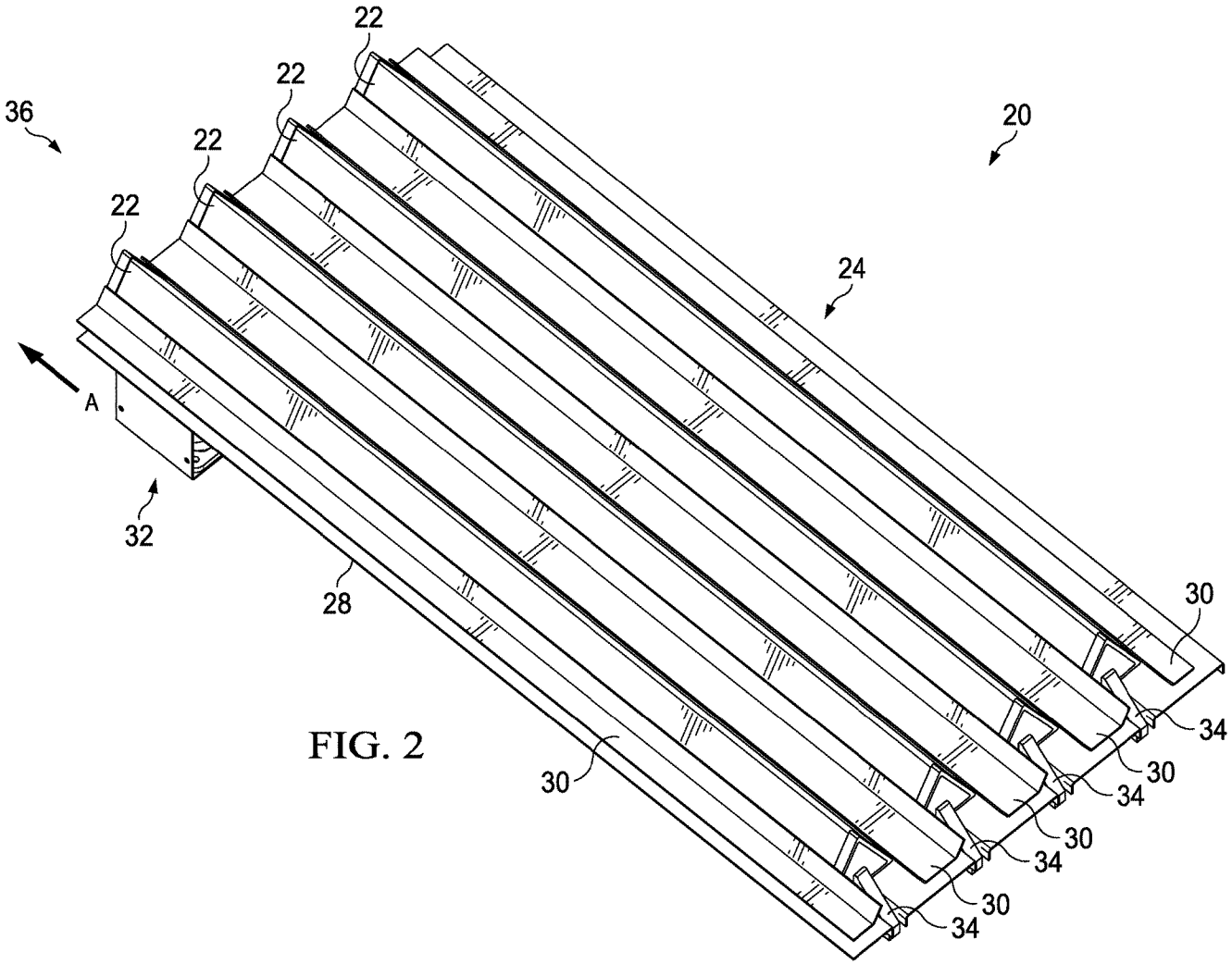
FIG. 2 is an upper isometric view depicting the propulsion unit and the deflation devices of FIG. 1.
Figure 3:
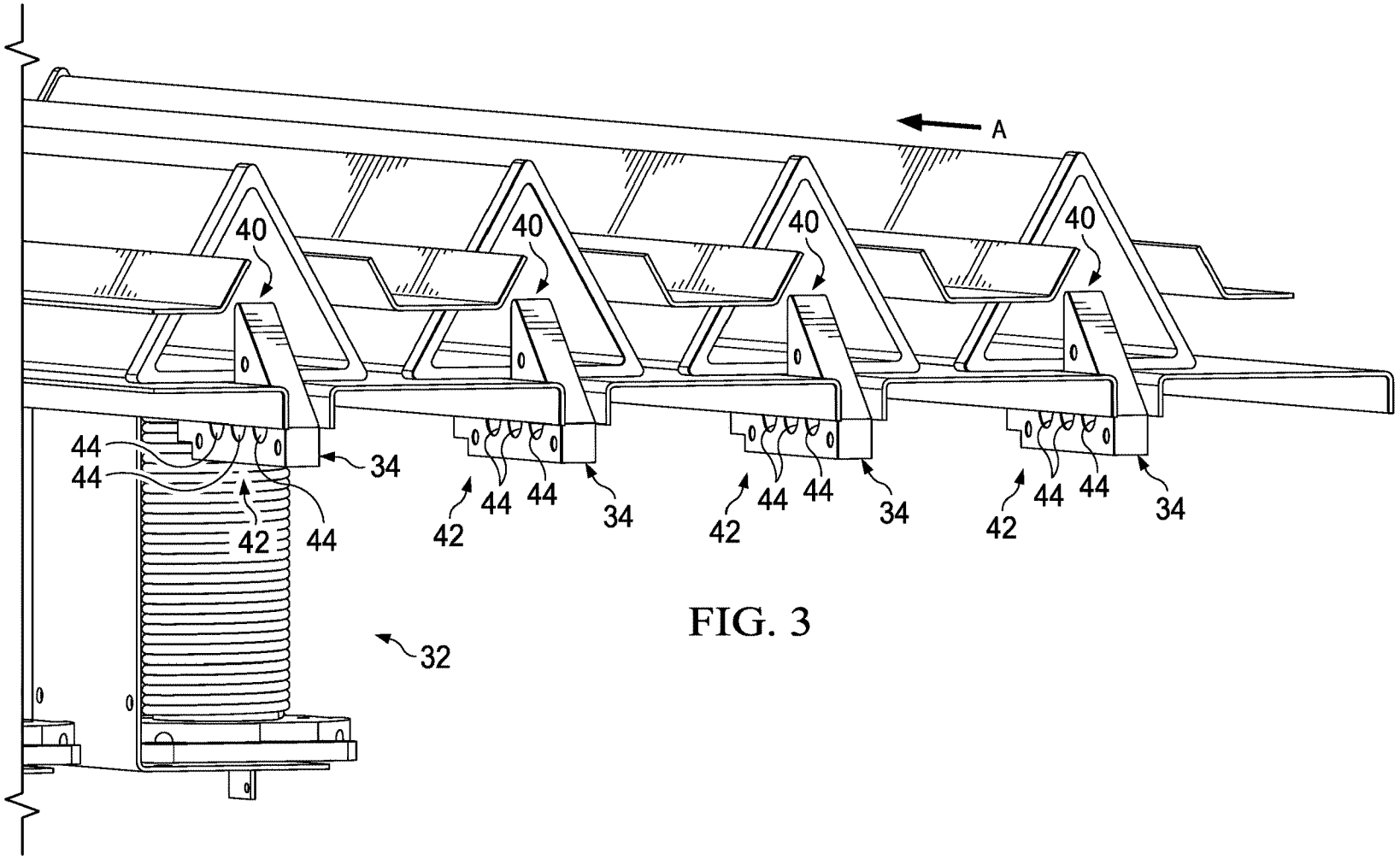
FIG. 3 is an enlarged rear isometric view depicting a portion of the propulsion unit and the deflation devices of FIG. 1.
Figure 4:
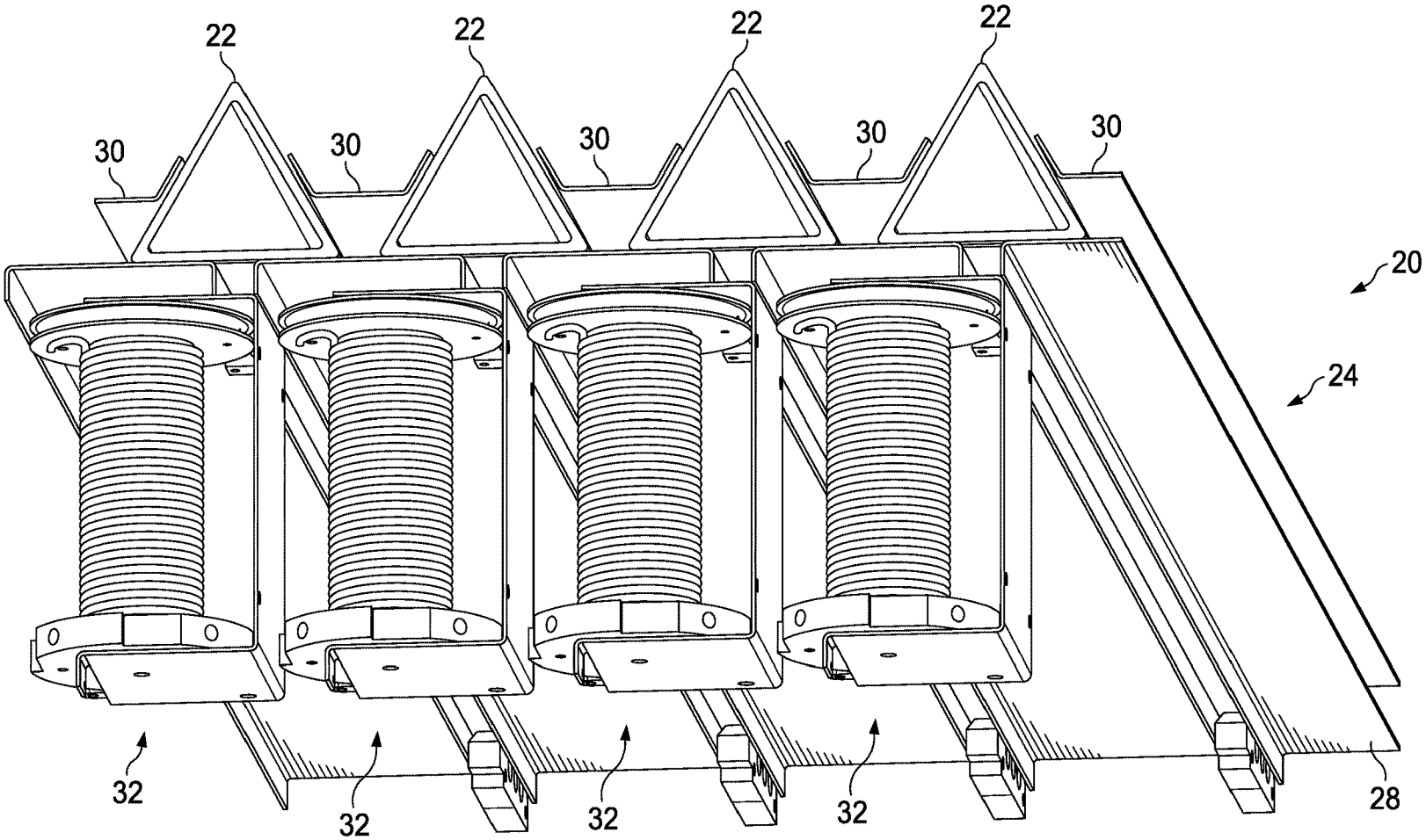
FIG. 4 is a front isometric view depicting the propulsion unit and the deflation devices of FIG. 1.
Figure 5:
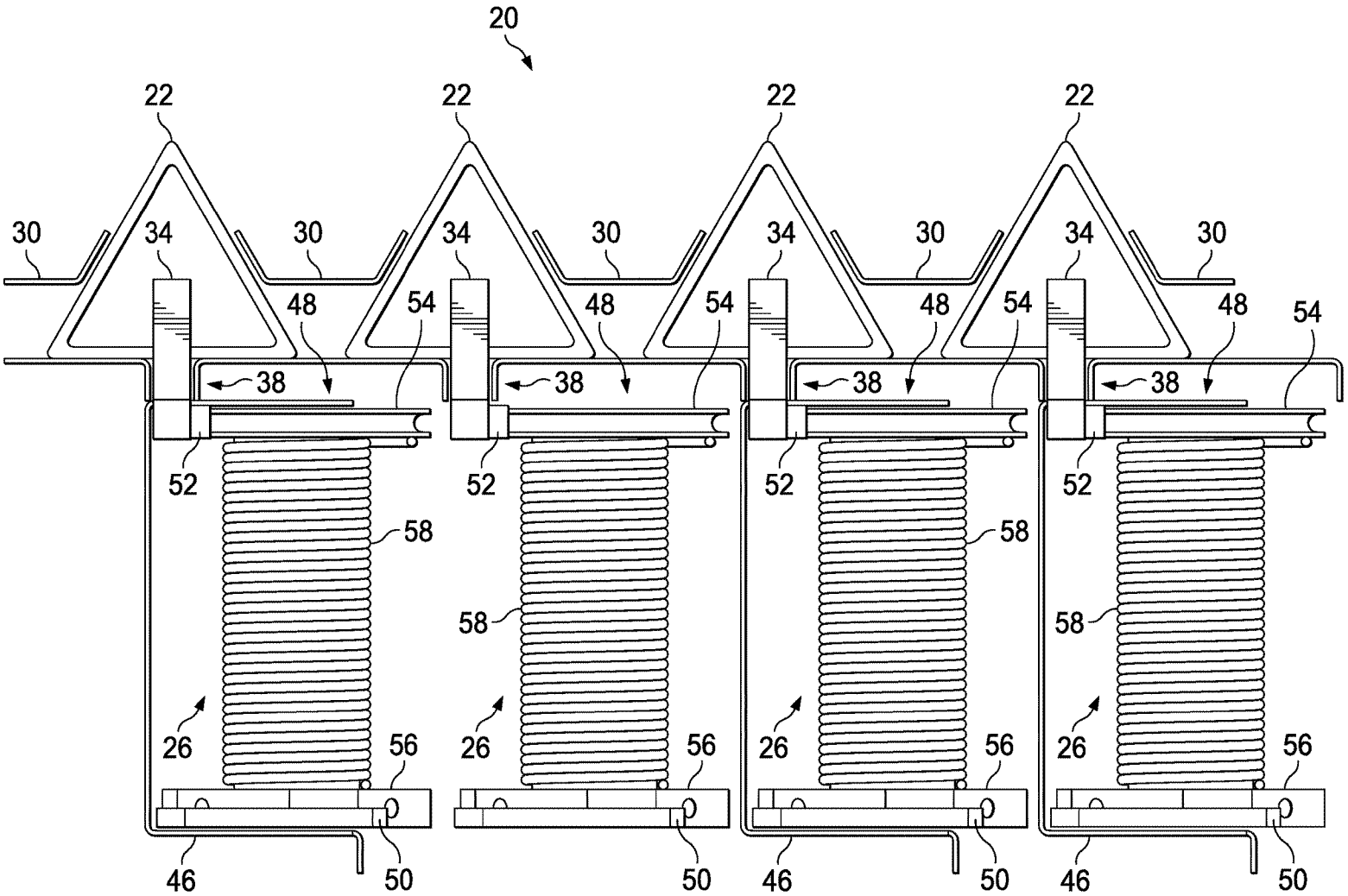
FIG. 5 is a rear sectional view depicting the propulsion unit and the deflation devices of FIG. 1.

In connection with the views and examples of FIGS. 1-38, wherein like numbers indicate the same or corresponding elements throughout the views, FIGS. 1-6 illustrate a propulsion unit 20 that is configured to propel a plurality of vehicular tire deflation devices 22 ("deflation devices") towards a target, such as a nearby roadway, for example. Various examples of a vehicular tire deflation device are described in U.S. Pat. Nos. D710,233; 6,155,745; 5,820,293; and 5,330,285, which are each incorporated herein by reference in their respective entireties. The propulsion unit 20 can include a platform 24 and a plurality of propulsion assemblies 26 disposed thereon and configured to facilitate selective launching of the deflation devices from the platform 24. The platform 24 can include a base 28 and a plurality of upper rails 30 that are coupled with the base 28 and interact with the deflation devices 22 to retain them on the base 28. The upper rails 30 can be spaced apart enough from each other to allow the deflation devices 22 to slide along the base 28.

Figure 6:
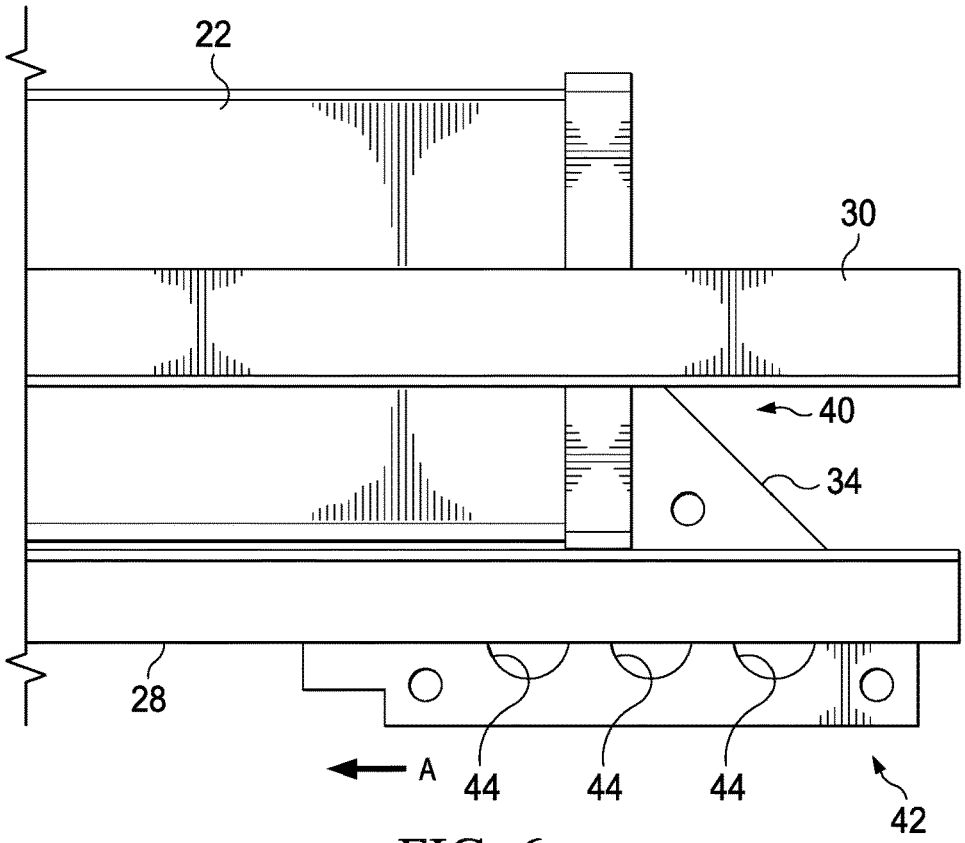
FIG. 6 is an enlarged side view depicting a portion of the propulsion unit and the deflation devices of FIG. 1.
Figure 7:
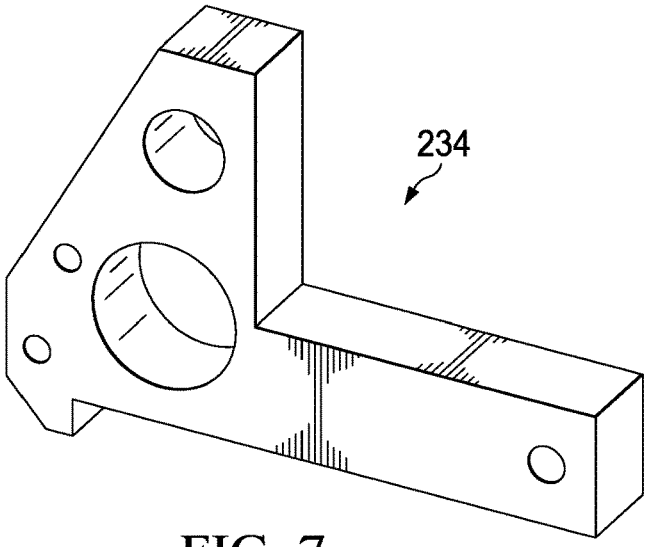
FIG. 7 is a front isometric view depicting a drive member, in accordance with another embodiment.
Figure 8:
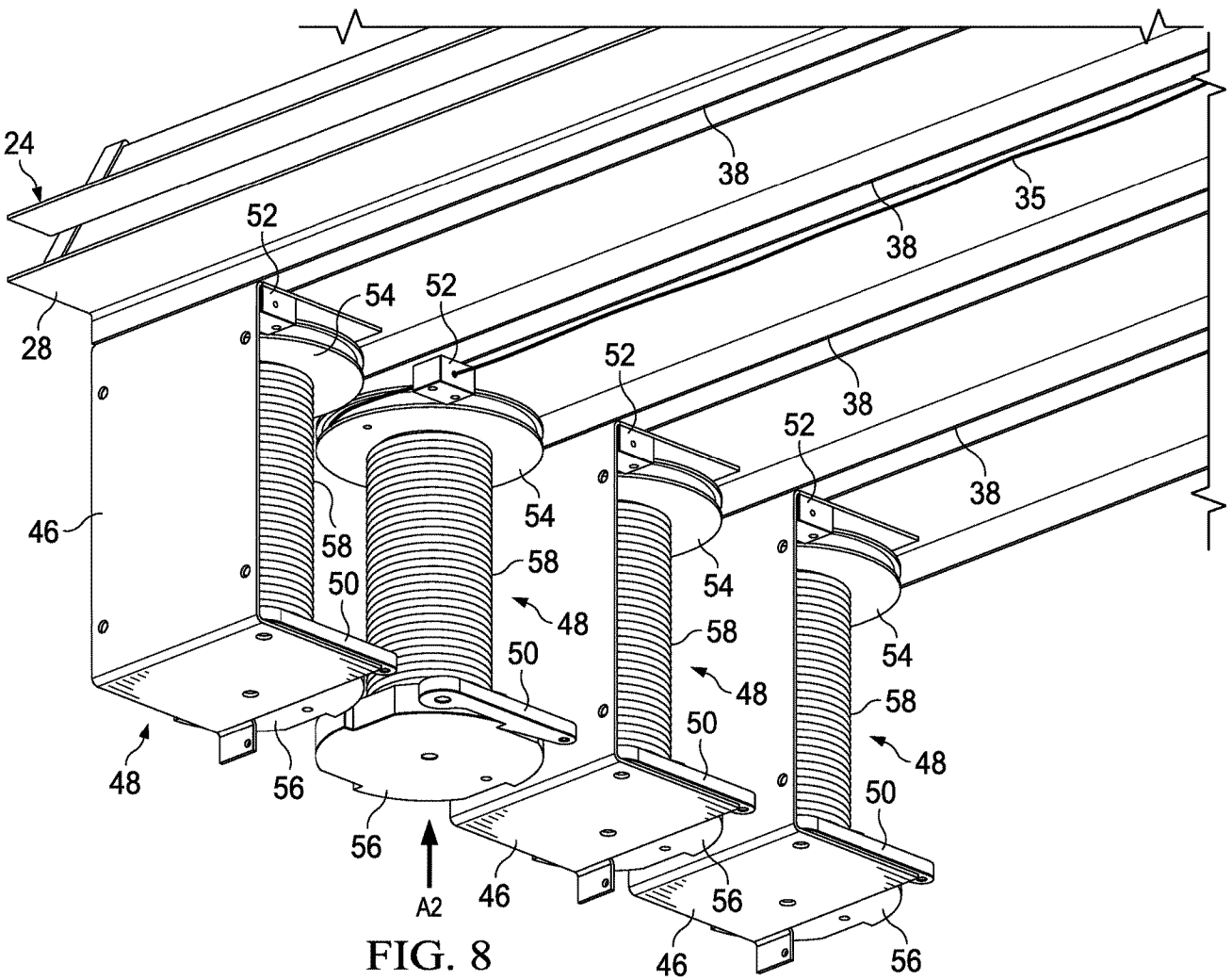
FIG. 8 is an enlarged lower rear isometric view depicting a portion of the propulsion unit and the deflation devices of FIG. 1.

Each of the propulsion assemblies 26 can include a spooling device 32 and a drive member 34 coupled with the spooling device 32 by a cable (e.g., 35 in FIG. 8). Each of the spooling devices 32 can be coupled with the base 28 at a front end 36 of the platform 24. The base 28 of the platform 24 can define a plurality of slots 38, and the drive members 34 can be slidably received within the slots 38. The drive members 34 can be slidably coupled with the base 28 and slidable between a loaded position (shown in FIG. 5) and an ejecting position (not shown). As illustrated in FIG. 6, the drive members 34 can have an upper portion 40 that is configured to interact with the deflation devices 22 and can also include a lower portion 42 that extends beneath the base 28. The lower portion 42 can define a plurality of holes 44 that can support wheels (45 in FIG. 13) that encourage sliding of the drive members 34 along the slots 38. An alternative embodiment of a drive member 234 is illustrated in FIG. 7 and can be similar to, or the same as, in many respects as the drive member 34. When the deflation devices 22 are loaded onto the platform 24 (e.g., by inserting them between the upper rails 30 at the front end 36 of the platform 24), the deflation devices 22 can contact the upper portion 40 of the drive members 34 and can encourage the drive members 34 into the loaded position, as shown in FIGS. 1-5. As will be described in further detail below, moving the drive members 34 into the loaded position can cause the spooling devices 32 to apply tension to the cable (e.g., 35 in FIG. 8) such that, when each of the drive members 34 is released from the loaded position, the spooling device 32 can facilitate pulling of the drive members 34 along the respective slots 38 towards the ejecting position, thereby ejecting the deflation devices 22 from the front end 36 of the platform 24 (in the direction of arrow A on FIG. 6) and propelling the deflation devices 22 towards a target. When the drive members 34 reach the ejecting position, they can contact stop members (not shown) that are configured to stop the drive members 34. In one embodiment, these stop members can include cushioning material that serves as a shock absorber for the drive members 34.

Figure 9:
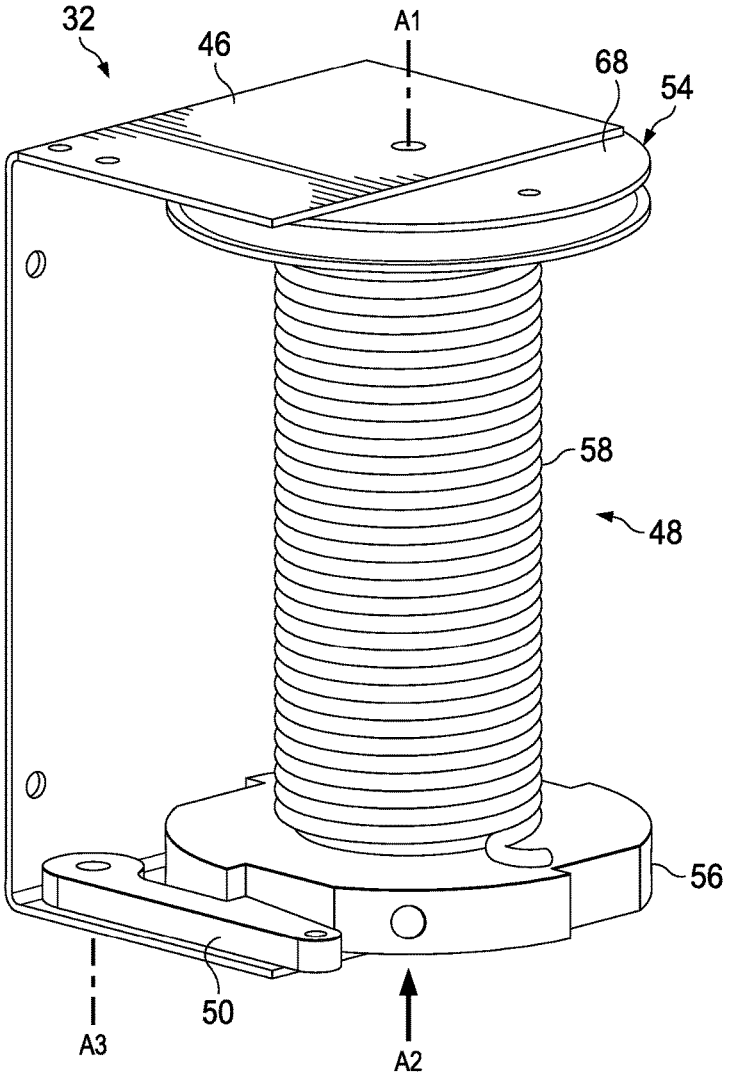
FIG. 9 is an isometric view depicting a spooling device of the propulsion unit of FIG. 1.

Referring now to FIGS. 8-9, one of the spooling devices 32 will now be described in further detail as an example of the rest of the spooling devices 32. The spooling device 32 can include a support bracket 46, a spool 48, a latch 50, and a guide member 52. The spool 48 can be rotatably coupled with the support bracket 46 and can include an upper pulley 54, a lower flange 56, and a spring 58 coupled with each of the upper pulley 54 and the lower flange 56. The upper pulley 54 and the lower flange 56 can be rotatable with respect to each other about an axis A1. When the upper pulley 54 and the lower flange 56 are rotated with respect to each other, the spring 58 applies a torsional force between the upper pulley 54 and the lower flange 56 to urge the upper pulley 54 and the lower flange 56 back to their original positions. In one embodiment, as illustrated in FIGS. 8 and 9, the spring 58 is shown to be a torsion spring, but it is to be appreciated that any of a variety of suitable alternative resilient members can be utilized.

Figure 10:
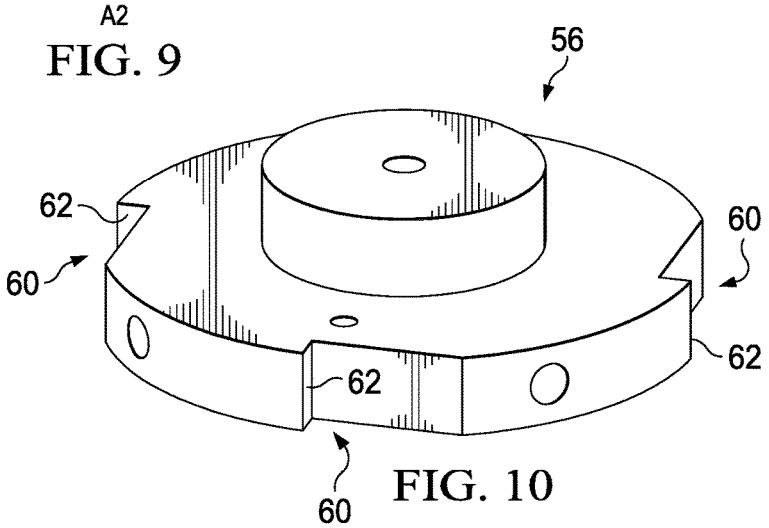
FIG. 10 is an isometric view depicting a lower flange of the spooling device of FIG. 9.
Figure 11:
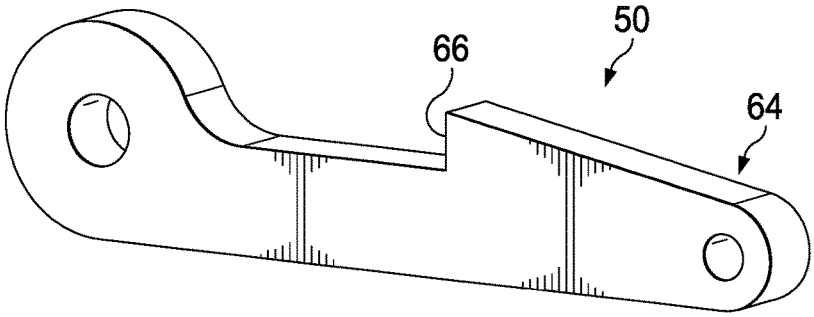
FIG. 11 is an isometric view depicting a latch of the spooling device of FIG. 9.
Figure 12:
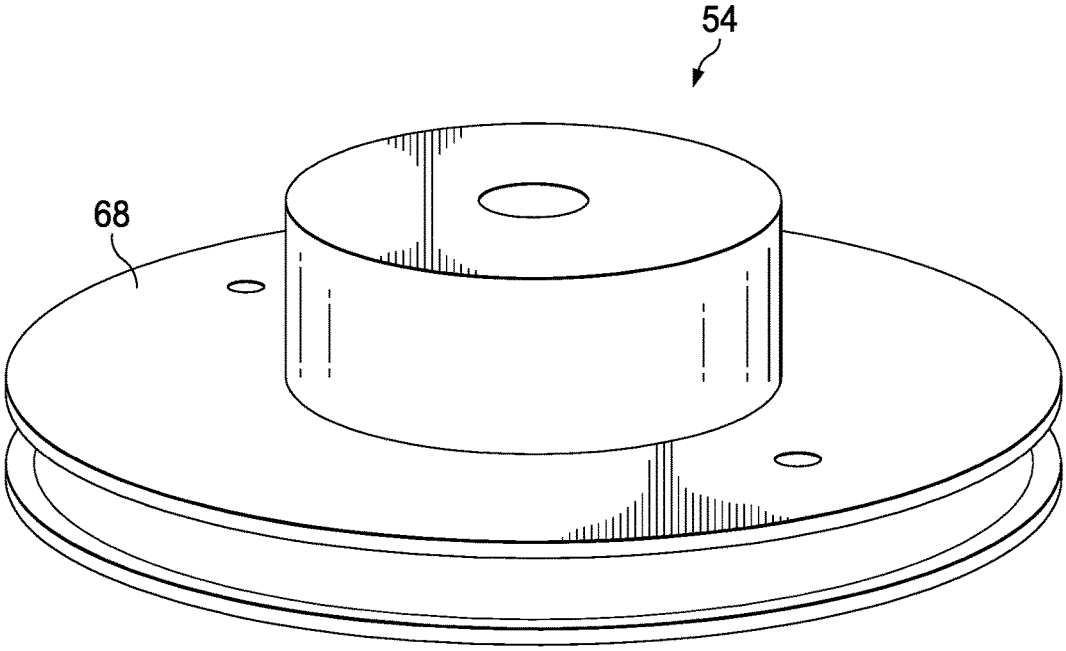
FIG. 12 is an isometric view depicting an upper spool member of the spooling device of FIG. 9.

The latch 50 and the lower flange 56 can be configured to cooperate together to lock the lower flange 56 in place when the spool 48 is rotated clockwise (when viewed in the direction of arrow A2 on FIGS. 8 and 9). As illustrated in FIG. 10, the lower flange 56 can define a plurality of circumferential notches 60 each having a shoulder 62. As illustrated in FIG. 11, the latch 50 can include a finger member 64 having a shoulder 66 such that the overall shape of the finger member 64 corresponds with the shape of the circumferential notches 60 of the lower flange 56. As illustrated in FIG. 9, the latch 50 can be provided adjacent to the lower flange 56 such that the shoulder 66 of the latch 50 can extend into one of the circumferential notches 60 and can abut the shoulder 62 of the lower flange 56. The latch 50 can be pivotable about an axis A3 (FIG. 9) and can be biased against the lower flange 56 by a spring (not shown) or other resilient member. When the upper pulley 54 is rotated in a clockwise direction, the latch 50 can prevent the lower flange 56 from rotating, thereby applying torsion to the upper pulley 54 in the counterclockwise direction.

The upper pulley 54 can include a spool head 68 (e.g., FIG. 9) that is coupled with a cable (e.g., 35 in FIG. 8) which is routed from the spool head 68, through the guide member 52 and to the drive member 34. The cable (e.g., 35 in FIG. 8) can be wound around the spool head 68 to facilitate collection/dispensation thereon/therefrom.

When the drive member 34 is pulled from the ejecting position to the loaded position, the upper pulley 54 can rotate clockwise to allow dispensation of the cable therefrom. As the upper pulley 54 is rotated, the spring 58 can apply an increasing torsion force to the upper pulley 54 which is then imparted to the cable (e.g., 35 in FIG. 8). When one of the deflation devices 22 is loaded onto the platform 24 and the drive member 34 is release from the loaded position, the spring 58 can cause the upper pulley 54 to rotate in a counterclockwise direction. The cable (e.g., 35 in FIG. 8) can be collected onto the spool head 68 which can pull the drive member 34 to the ejected position, thereby facilitating ejection of the deflation device 22 from the platform 24.

Figure 13:
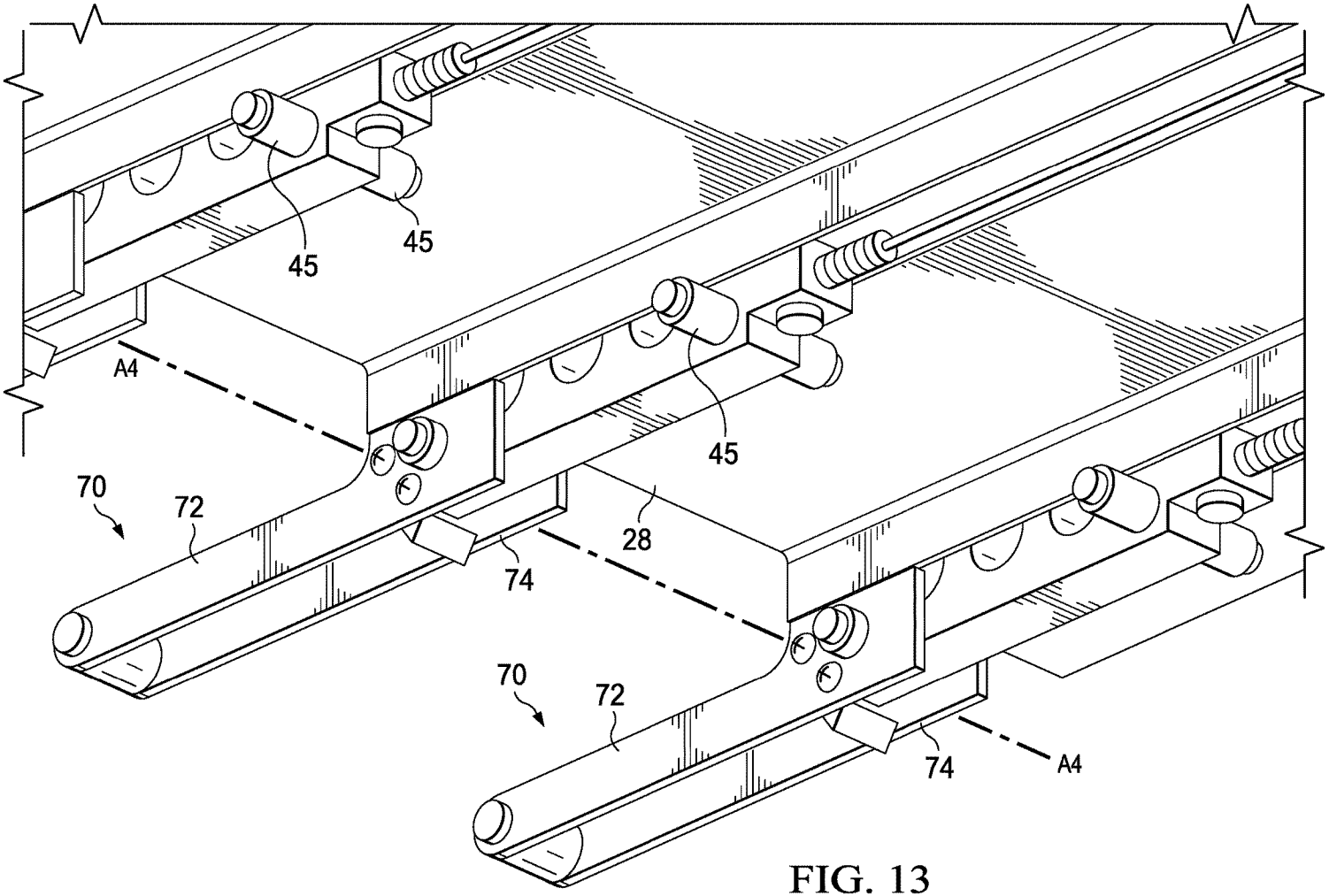
FIG. 13 is an enlarged lower rear isometric view depicting a portion of a propulsion unit, according to another embodiment.

In one embodiment, as illustrated in FIG. 13, the propulsion unit 20 can include a plurality of latching mechanisms 70 that are configured to selectively retain each drive member 34 in their loaded position. Each latching mechanism 70 can include a handle 72 and an arm member 74 and can be pivotable about an axis A4. When the drive member 34 is in the loaded position, the arm member 74 can engage a pair of the support wheels 45 to hold the drive member 34 in place. To release the drive member 34 and launch the deflation device 22, the handle 72 can be pulled upwardly to pivot the arm members 74 away from the drive member 34. The latching mechanism 70 can be operated manually and/or via a powered arrangement, such as, for example, a solenoid. Although the latching mechanisms 70 are shown to be independent from one another to allow for individual operation, it is to be appreciated that in some embodiments, the latching mechanisms 70 can be coupled together (e.g., with a rod) such that the latching mechanisms 70 are actuated simultaneously. It is also to be appreciated that any of a variety of suitable alternative latching mechanisms can be utilized.

The lower flange 56 can be selectively rotatable with respect to the upper pulley 54 to vary the tension on the cable and thus the propulsion distance of the associated deflation device 22. In the example of FIGS. 8 and 9, the lower flange 56 can be rotated in the counterclockwise direction to increase the tension and in the clockwise direction to decrease the tension. When the lower flange 56 is rotated in the counterclockwise direction, the latch 50 can ride freely along the lower flange 56 and past the circumferential notches 60 (FIG. 10). When the lower flange 56 reaches its desired position and is released, the latch 50 can engage one of the circumferential notches 60 to hold the lower flange 56 in place. However, the latch 50 can prevent rotation of the lower flange 56 in the clockwise direction. As such, the latch 50 can be urged away from the lower flange 56 and clear of the circumferential notches 60 to allow the lower flange 56 to be rotated in the clockwise direction. When the lower flange 56 reaches its desired position, the latch 50 can be released to allow it to engage one of the circumferential notches 60. It is to be appreciated that the lower flange 56 can be rotated manually (e.g., with a tool) or in any of a variety of other suitable manners (e.g., with a motor).

The respective tensions of each of the spooling devices 32 can be selected to provide the same or different propulsion distances among the deflation devices 22. In one embodiment, the tensions of the spooling devices 32 can be selected such that the propulsion distances are staggered. As such, the deflation devices 22 can be scattered at different distances along a roadway to provide sufficient coverage across the entire roadway. In some embodiments, a tether (not shown) can attach each of the deflation devices 22 to the platform 24. In such an embodiment, the respective lengths of the tethers can be selected to achieve a desired propulsion distance for each deflation device.

It is to be appreciated that the propulsion unit 20 can allow for the deflation devices 22 to be provided on a roadway without requiring an individual to closely approach or enter the roadway.

Figure 14:
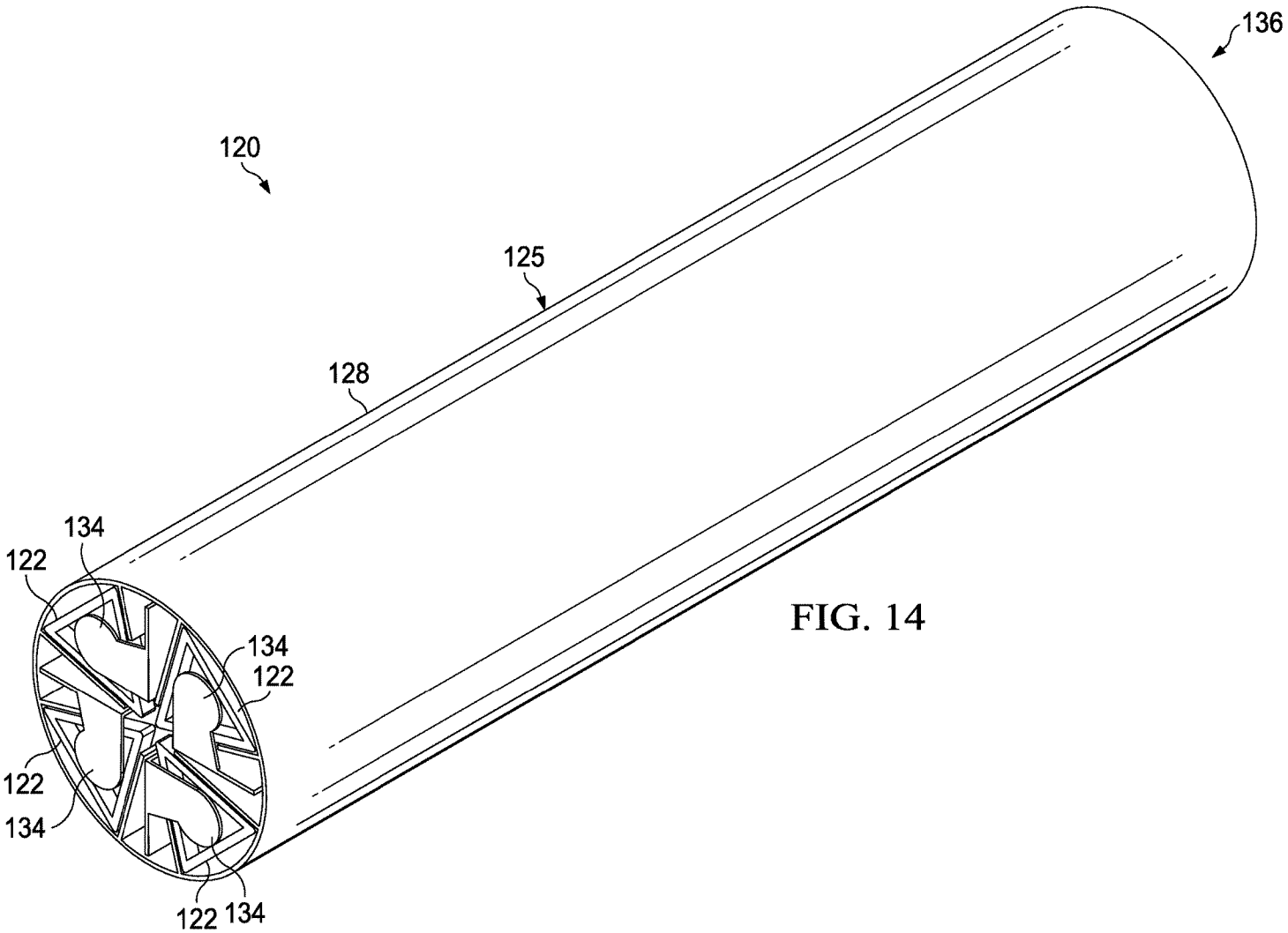
FIG. 14 is a rear isometric view depicting a propulsion unit and a plurality of deflation devices, in accordance with another embodiment.
Figure 15:
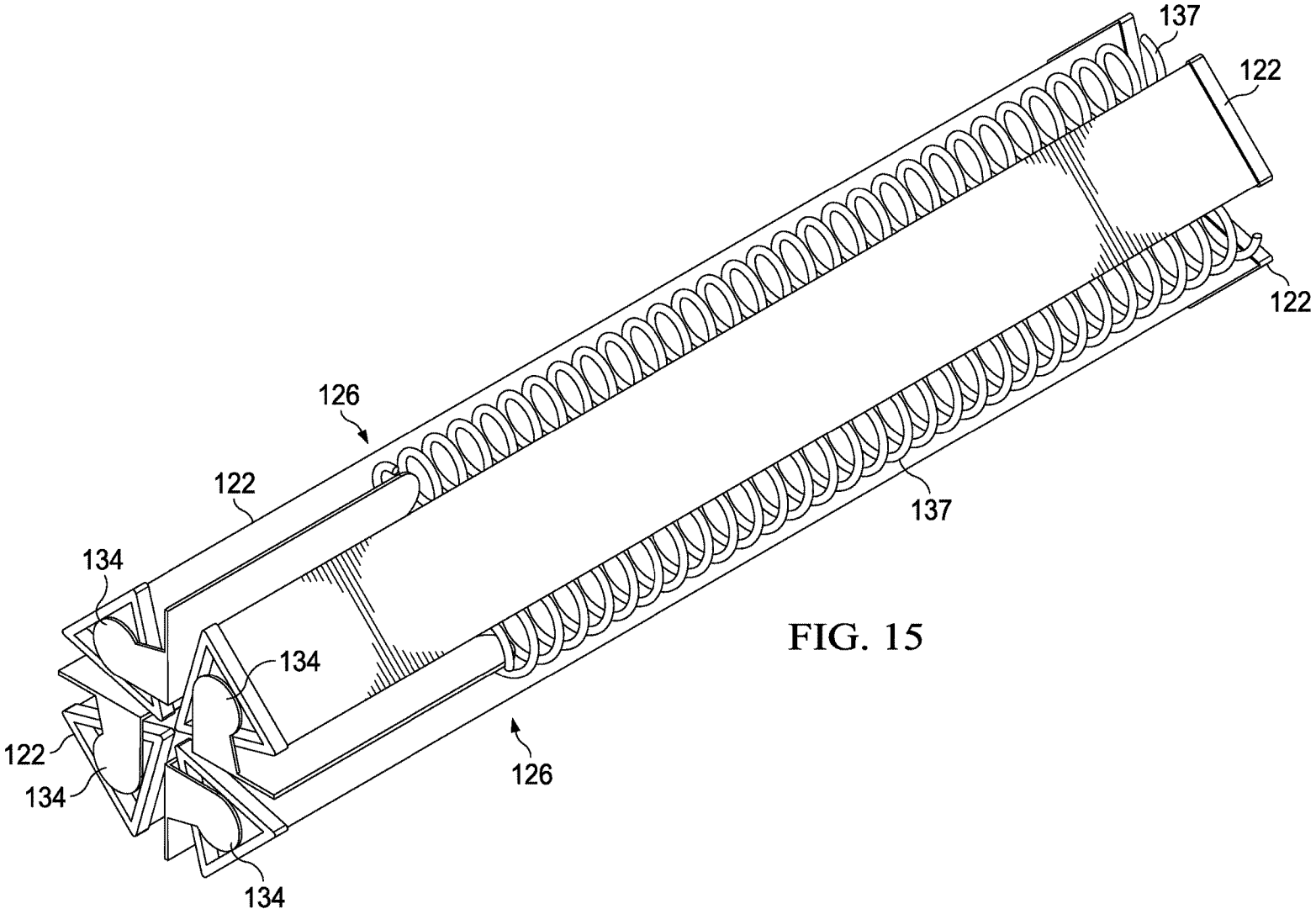
FIG. 15 is a rear isometric view depicting the propulsion unit of FIG. 14 but with certain components removed for clarity of illustration.
Figure 16:
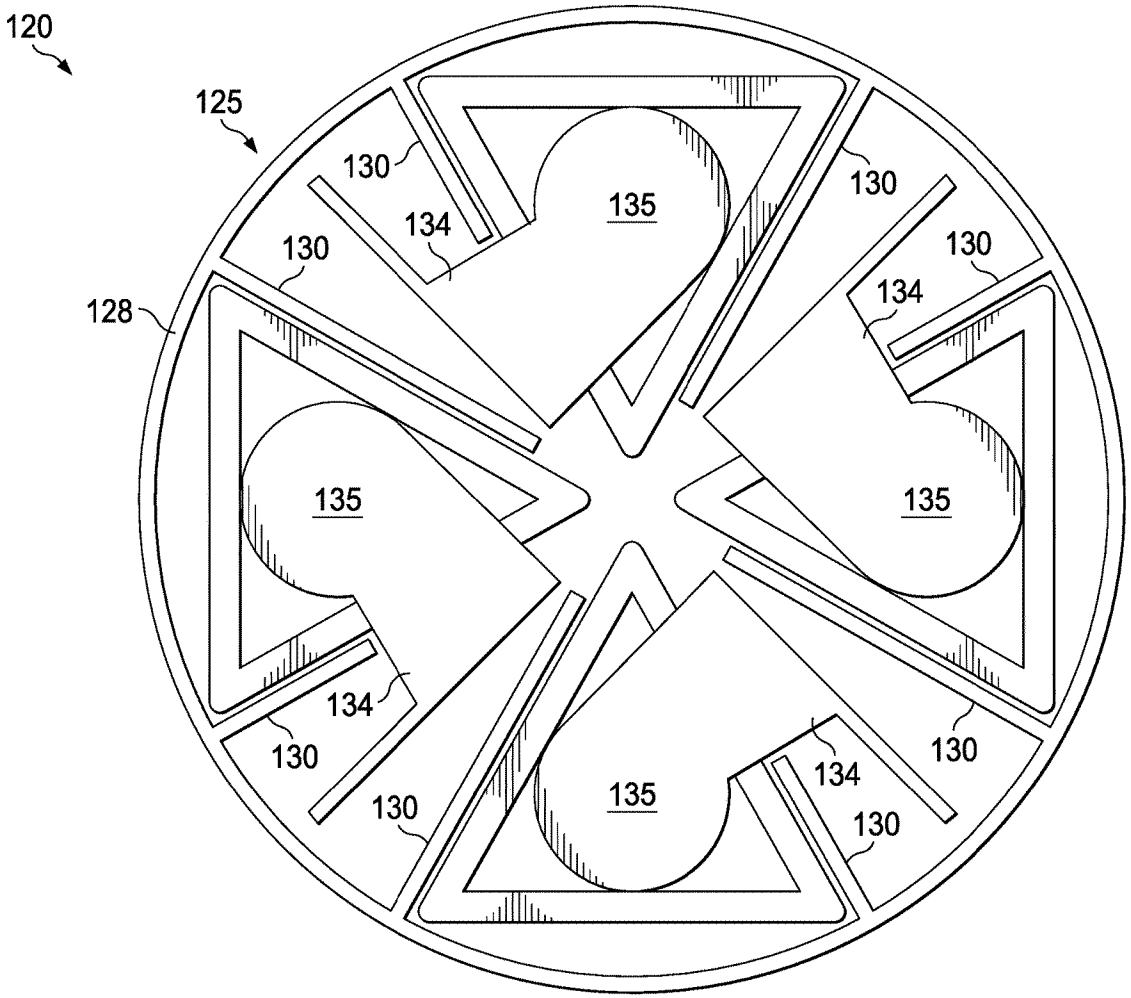
FIG. 16 is a rear view depicting the propulsion unit of FIG. 14.

FIGS. 14-17 illustrate a propulsion unit 120 according to another embodiment. The propulsion unit 120 can be similar to, or the same as, in many respects as the propulsion unit 20 of FIGS. 1-13. For example, the propulsion unit 120 can have a plurality of propulsion assemblies 126 (FIG. 15) that facilitate propulsion of a plurality of vehicular tire deflation devices 122 ("deflation devices") towards a target, such as a nearby roadway, for example. However, as illustrated in FIGS. 14 and 16, the propulsion unit 120 can include a canister 125 having an outer base 128 and a plurality of rails 130 that are coupled with the outer base 128. The plurality of rails 130 can extend radially inwardly from the outer base 128 and can interact with the deflation devices 122 to retain them within the canister 125 and separate them with respect to each other.

Referring now to FIG. 15, each of the propulsion assemblies 126 can include a drive member 134 and a biasing member 137 that is coupled with the drive member 134 at one end and with the canister 125 at the other end. Each of the drive members 134 can include a tab portion 135 (FIG. 16) that engages one end of the deflation devices 122.

The drive members 134 can be slidable within the canister 125 between a loaded position (shown in FIGS. 14 and 15) and an ejecting position (not shown). When the drive members 134 are in their loaded positions, the biasing members 137 can bias the drive members 134 towards the ejecting position. When the deflation devices 122 are loaded into the canister 125 such that the drive members 134 are in their loaded positions, the biasing members 137 can thus facilitate propulsion of the deflation devices 122 from the canister 125. Although the biasing member 137 is shown to include a spring, it is to be appreciated that any of a variety of biasing members can be utilized.

Referring now to FIG. 16, some of the rails 130 can be shorter than others of the rails 130. The rails 130 that are shorter can be short enough to allow the most proximate drive member 134 to pass over when moved between the loaded and ejecting positions.

Figure 17:
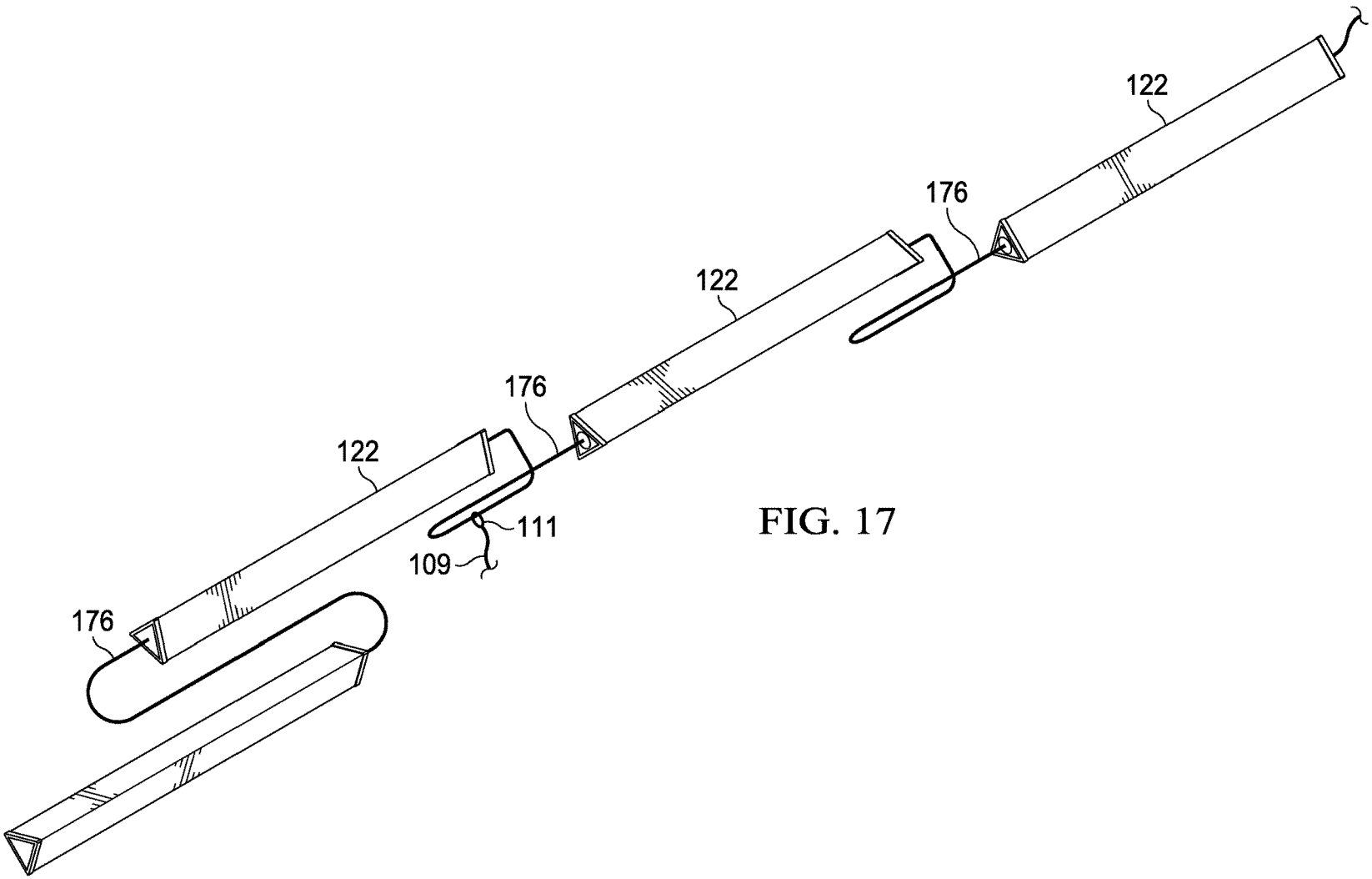
FIG. 17 is an isometric view depicting the deflation devices of FIG. 14.
Figure 18:
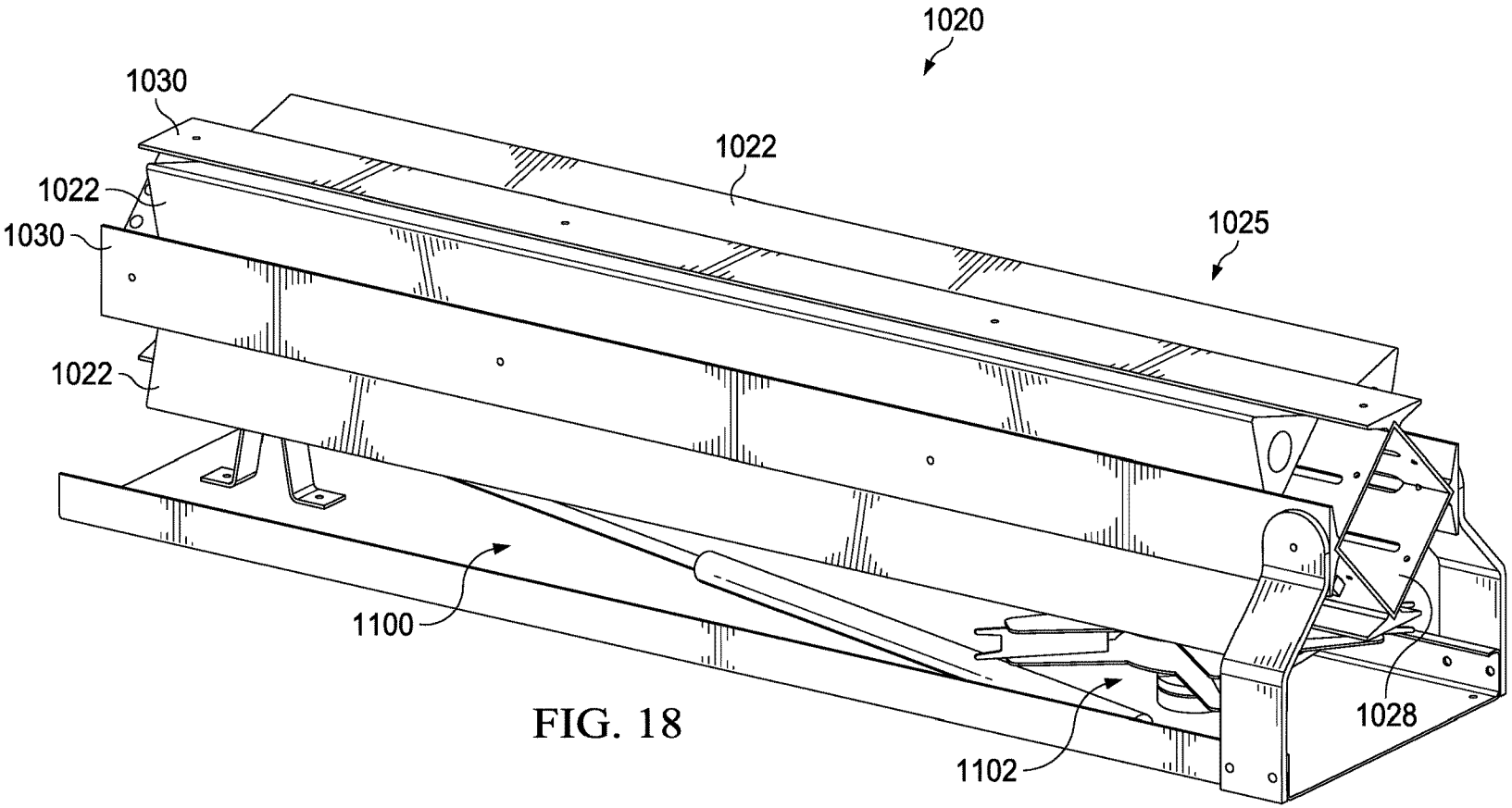
FIG. 18 is a rear isometric view depicting a propulsion unit and a plurality of deflation devices, in accordance with one embodiment, the propulsion unit including a spool.

Referring now to FIG. 17, in one embodiment, a tether 176 can be routed through each of the deflation devices 122 and attached to an end of one of the deflation devices 122. The length of the tether 176 can be selected to achieve a desired propulsion distance and/or layout pattern for each deflation device 122. A ring 111 can surround the tether 176 to facilitate attachment of a retraction cable 109 thereto that enables retraction of the deflation devices 122 from a target, as will be described in further detail below. The ring 111 can be disposed between adjacent deflation devices 122 such that two of the deflation devices reside on either side of the ring 111.

In one embodiment, the propulsion unit 120 can include a latching mechanism (not shown) that is similar to latching mechanism 70 shown in FIG. 13, but instead having latches (e.g., 50) coupled with arm members (e.g., 74) that are provided in a circumferential arrangement to facilitate selective engagement and releasement of the drive members 134. The latches can be either simultaneously released or sequentially released in a desired order to allow for a desired layout pattern along a roadway. In some embodiments, the latching mechanism can be electronically actuated, such as with solenoids, for example. In such embodiments, actuation of these latching mechanisms can be controlled with an electronic control unit (not shown) that facilitates simultaneous or sequential actuation of the latching mechanism.

It is to be appreciated that the canister-type arrangement of the propulsion unit 120 shown in FIGS. 14-17 can provide ease of portability and set up at a location for deployment. In some embodiments, the propulsion unit 120 can include fold out legs (not shown) at a front end 136 to allow for angling of the propulsion unit 120 at a desired propulsion angle.

FIGS. 18-33 illustrate a propulsion unit 1020 according to another embodiment. The propulsion unit 1020 can be similar to, or the same as, in many respects as the propulsion units 20 and 120 of FIGS. 1-13 and 14-17, respectively. For example, as illustrated in FIGS. 19-22, the propulsion unit 1020 can have a plurality of propulsion assemblies 1026 that facilitate propulsion of a plurality of deflation devices 1022 towards a target. The propulsion unit 1020 can include a canister 1025 having a base 1028 and a plurality of rails 1030 that are coupled with the base 1028. The plurality of rails 1030 can extend from the base 1028 and can interact with the deflation devices 1022 to retain them on the base 1028 and separate them with respect to each other.

Figure 19:
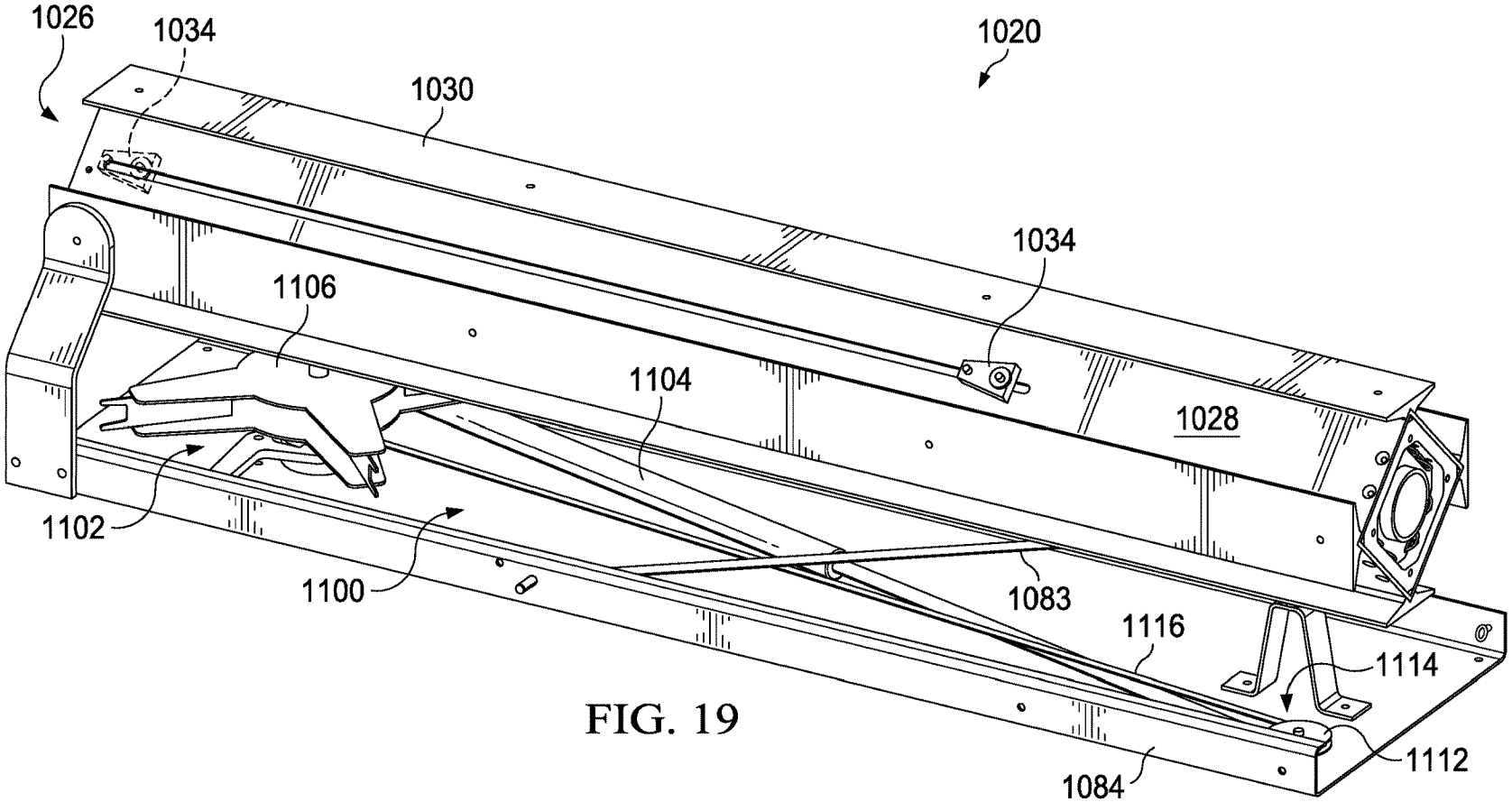
FIG. 19 is a front isometric view depicting the propulsion unit of FIG. 18, wherein the plurality of deflation devices have been removed for clarity of illustration.
Figure 20:
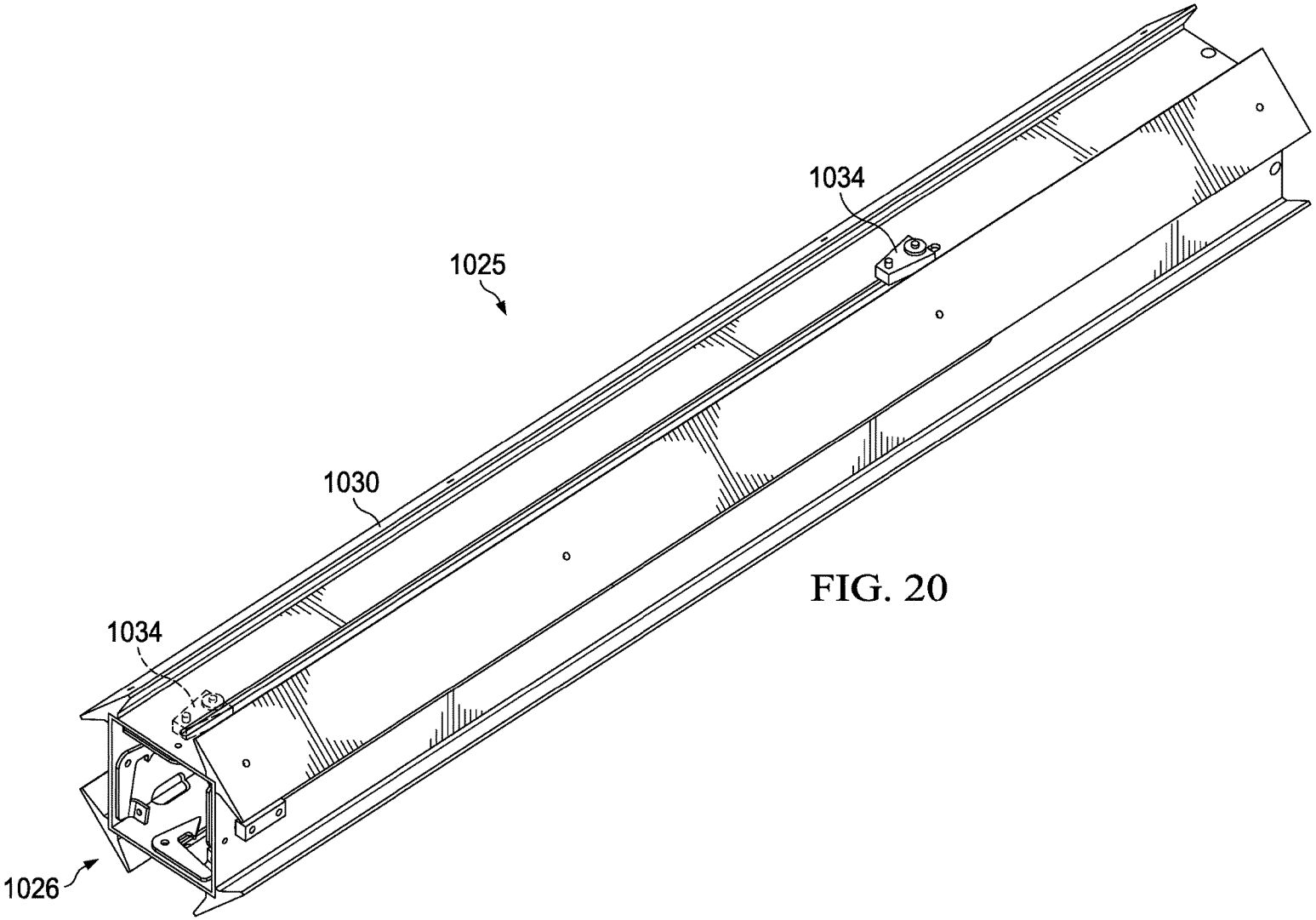
FIG. 20 is a rear isometric view depicting a canister of the propulsion unit of FIG. 18.
Figure 21:
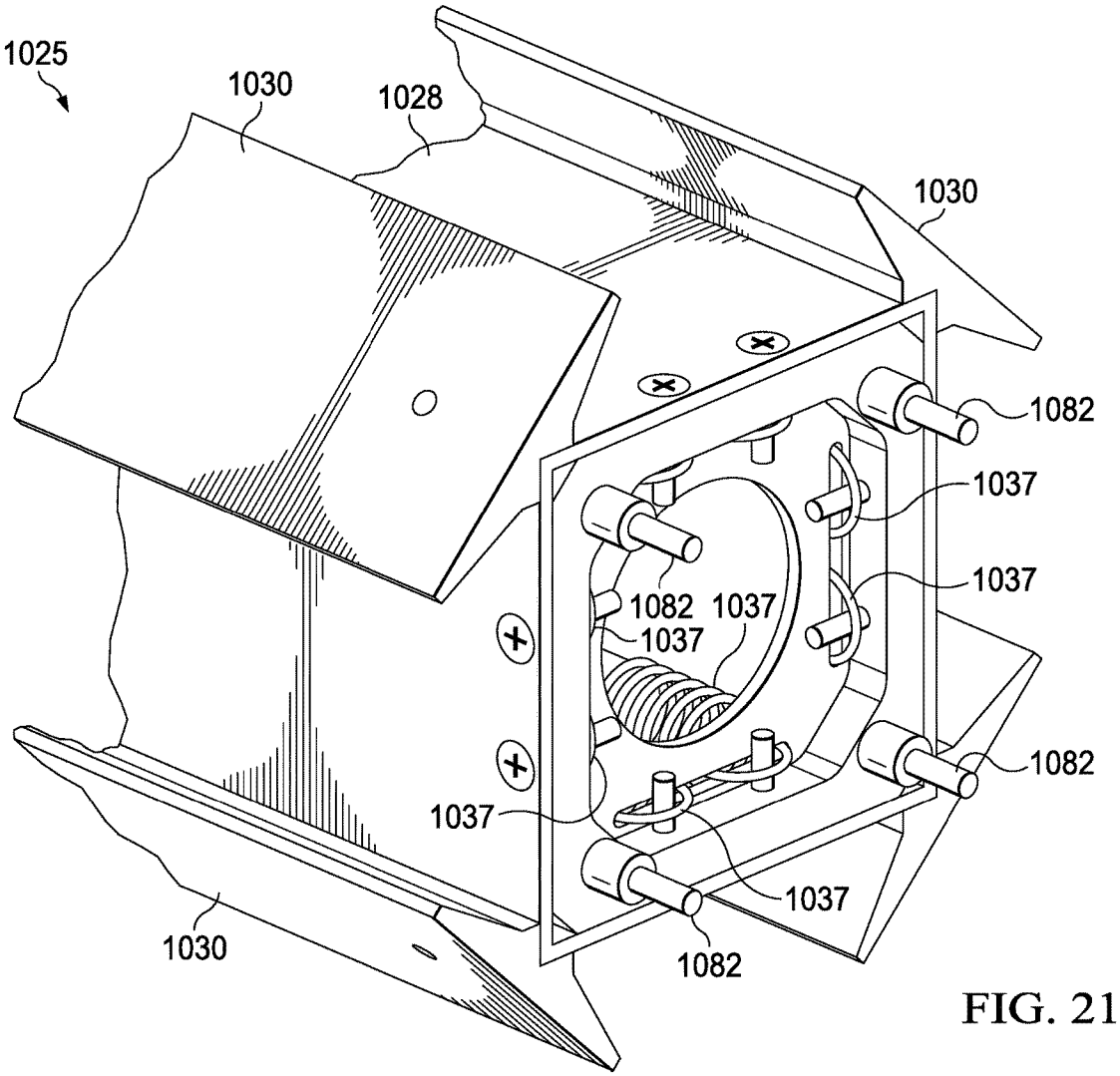
FIG. 21 is a front enlarged isometric view depicting the canister of FIG. 20.

Referring now to FIGS. 19-21, each of the propulsion assemblies 1026 can include a drive member 1034 and a plurality of biasing members 1037 that are each coupled with the drive member 1034 at one end and with the base 1028 at the other end. The drive members 1034 can be slidable within the base 1028 between a loaded position (shown in dashed lines in FIGS. 19 and 20) and an ejecting position (shown in solid lines in FIGS. 19 and 20). When the drive members 1034 are in their ejecting positions, the deflation devices 1022 can be loaded onto the propulsion unit 1020 thereby driving the drive members 1034 into their loaded positions. With the drive members 1034 in their loaded positions, the biasing members 1037 can bias the drive members 1034 towards the ejecting position. The biasing members 1037 can thus facilitate propulsion of the deflation devices 1022 from the base 1028 when the deflation devices 1022 are released. Although the biasing member 1037 is shown to include a spring, it is to be appreciated that any of a variety of biasing members can be utilized.

Figure 22:
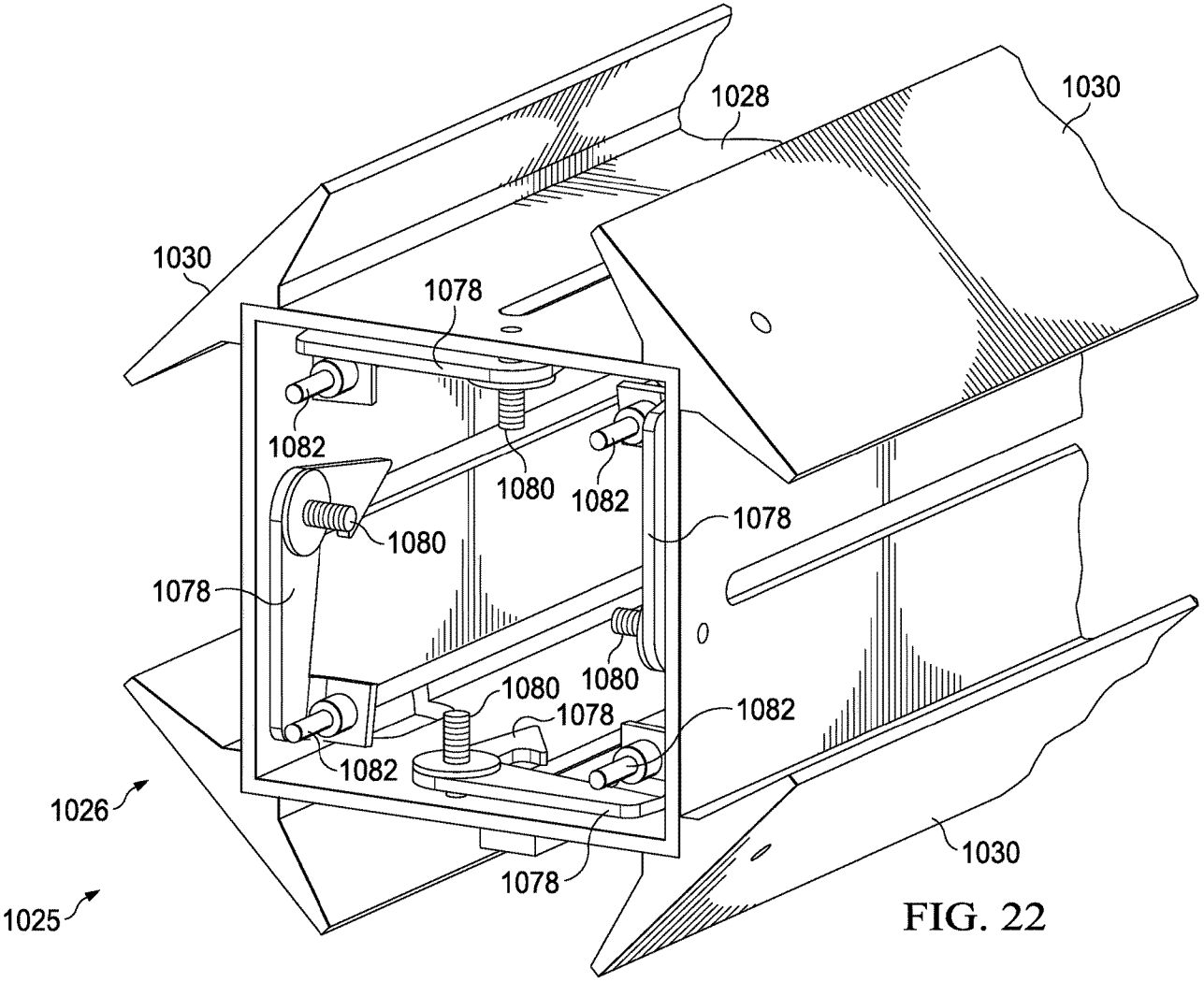
FIG. 22 is a rear enlarged isometric view depicting the canister of FIG. 20.
Figure 23:
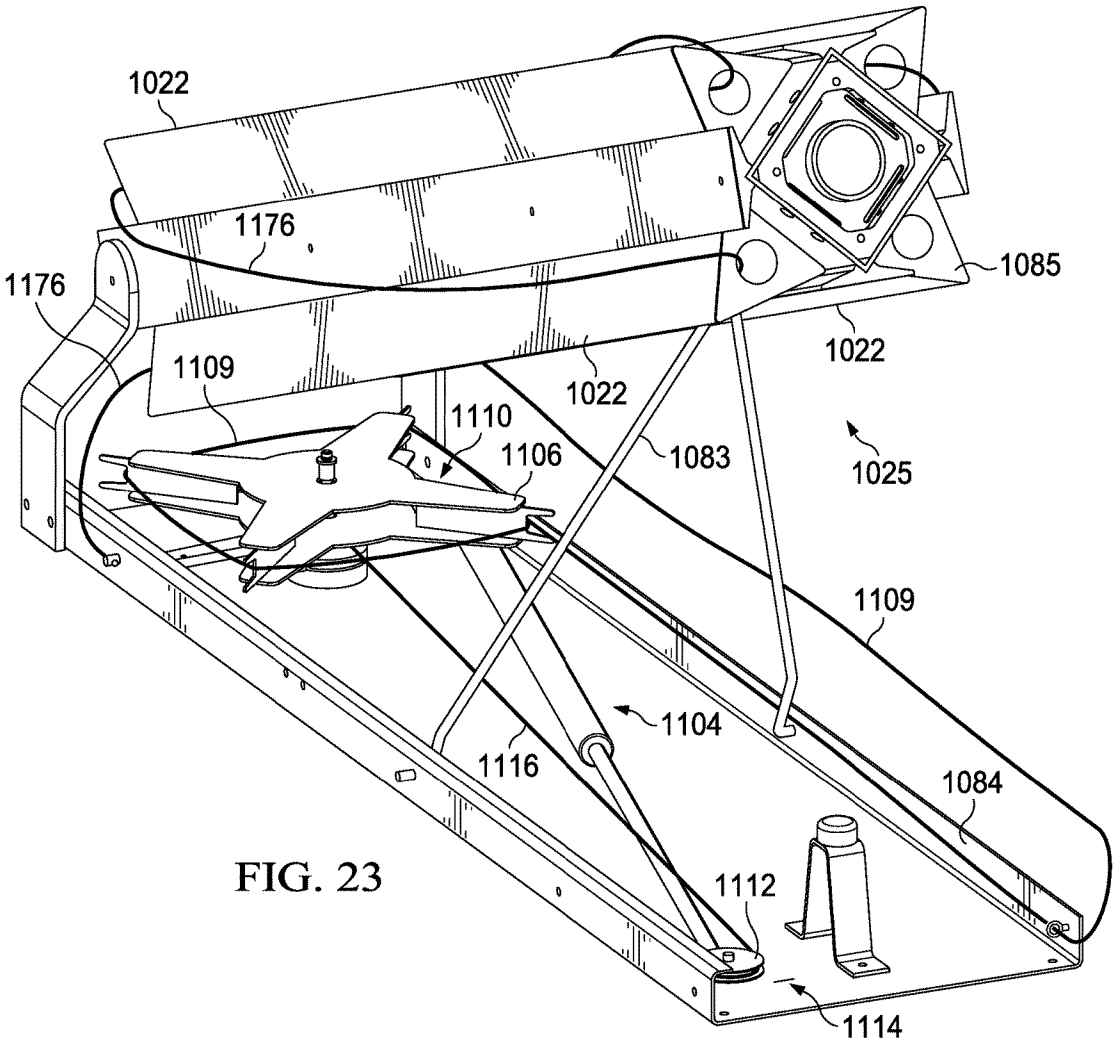
Figure 24:
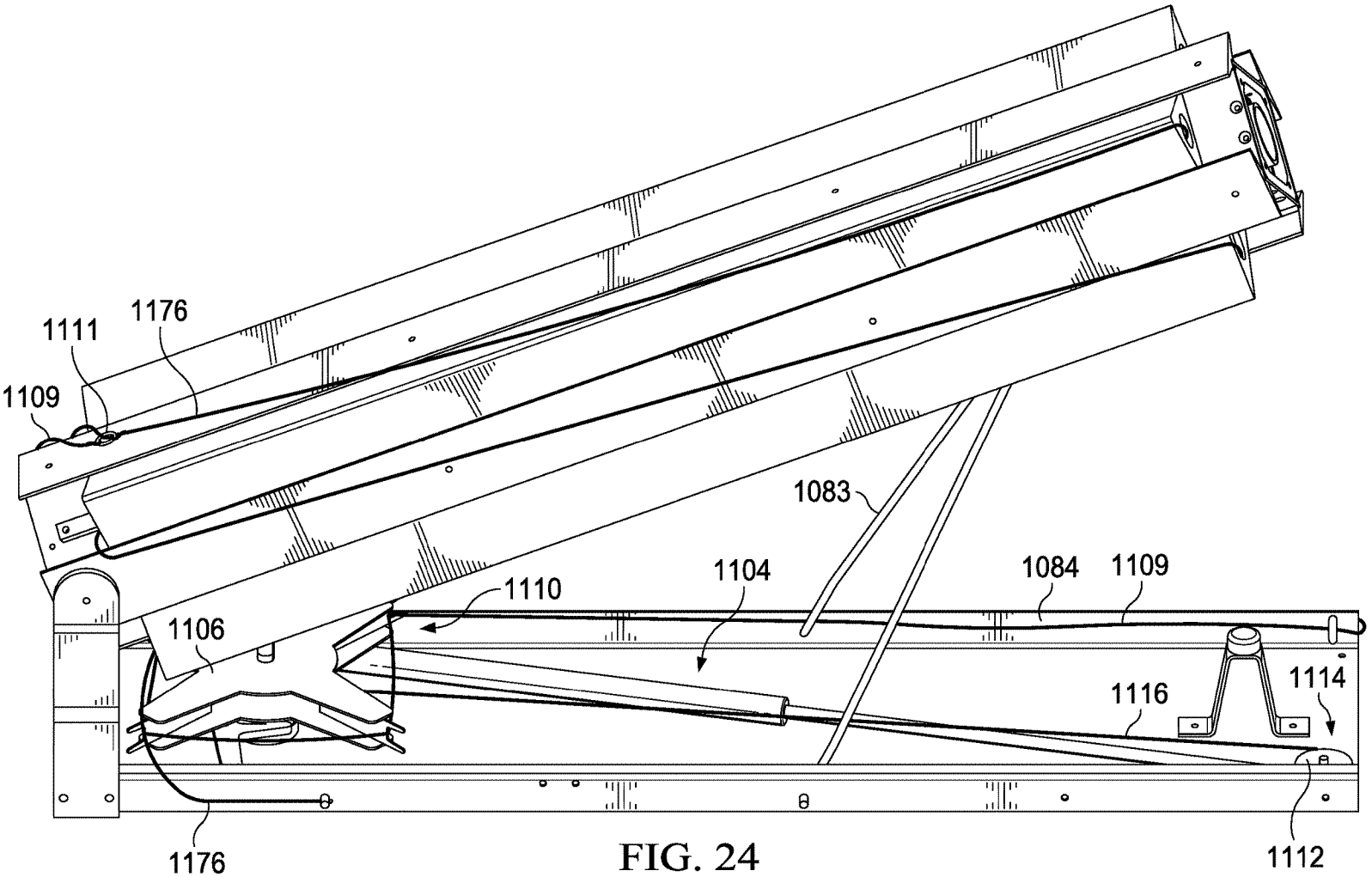

Referring now to FIGS. 21 and 22, each of the propulsion assemblies 1026 can include a latching mechanism 1078 that is pivotally coupled with the base 1028 by a bolt 1080 and pivotable between a latched position (shown in FIG. 22) and a released position (not shown). When in the latched position, each latching mechanism 1078 can selectively engage one of the drive members 1034 to retain the drive member 1034 in the loaded position. When the latching mechanism 1078 is moved to the released position, the associated drive member 1034 can slide from the loaded position to the ejecting position (e.g., due to the force from the biasing member) thus propelling the associated deflation device 1022 from the propulsion unit 1020.

Each of the latching mechanisms 1078 can be coupled with a post 1082 that is slidable with respect to the base 1028 in the sliding direction of the drive member 1034 between a released position (FIG. 22) and an actuated position (not shown). Each of the posts 1082 can include an engagement member (not shown) that is disposed inside of the base 1028 and intersects the travel path of one of the drive members 1034 adjacent to its ejecting position. When one of the drive members 1034 slides into the ejecting position (thus propelling the associated deflation device 1022 from the propulsion unit 1020), it can engage the engaging member (not shown) and pull the associated post 1082 in the same direction. The latching mechanism 1078 attached to the post 1082 is associated with an adjacent drive member 1034 and can be moved into the actuated position to release the associated drive member 1034.

Each of the posts 1082 and latching mechanisms 1078 can be arranged and can cooperate such that each drive member 1034 facilitates launching of an adjacent deflation device 1022 to facilitate sequential (e.g., staggered) launching of the deflation devices 1022. For example, the launch sequence can be initiated by actuating one of the latching mechanisms 1078. The drive member 1034 associated with that latching mechanism 1078 can slide to its ejecting position thus propelling the associated deflation device 1022 from the propulsion unit 1020. The drive member 1034 can simultaneously actuate the post 1082 of the adjacent latching mechanism 1078 thereby propelling the adjacent deflation device 1022 from the propulsion unit 1020. The process can continue until each of the deflation devices 1022 has been propelled from the propulsion unit 1020.

Referring now to FIGS. 18, 19, and 23-25A, the canister 1025 can be pivotally coupled to a support base 1084 and can be selectively pivoted between a collapsed position (FIGS. 18 and 19) and a deployed position (FIGS. 23-25A). When the canister 1025 is in the collapsed position, the propulsion unit 1020 can be compact and thus easily stored in a trunk of a vehicle or other confined space. When the propulsion unit 1020 is removed from the trunk and placed into service, the canister 1025 can be pivoted to the deployed position to allow for propelling of the deflation devices 1022 onto a roadway or other target. A support arm 1083 can provide underlying support to the canister 1025 when the canister 1025 is in the deployed position. The support arm 1083 can be collapsed when the canister 1025 is in the collapsed position. When the canister 1025 is pivoted to the deployed position, the support arm 1083 can be pivoted upwardly and into engagement with a clasp to support the canister 1025. The support arm 1083, when latched into the canister 1025, can provide an optimum launch angle for the canister 1025 and propulsion assemblies 1026 that will achieve a desired trajectory of the deflation devices 1022 when deployed.

The deflation devices 1022 can be attached to each other and to the support base 1084 by a tether 1176 (shown in FIGS. 23-25A). The tether 1176 can be attached at one end to the support base 1084, routed through each of the deflation devices 1022, and retained at one end of the deflation devices 1022 by a cap 1085 (see FIG. 23). The tether 1176 can be formed of an elastic material such that, when the deflation devices 1022 are deployed onto a roadway or other target, the tether 1176 is stretched. When the deflation devices 1022 initially land on the target, they can be scattered and in a random order. The elasticity of the tether 1176, however, can pull the deflation devices 1022 slightly back towards the propulsion unit 1020, which can align the deflation devices 1022 and bring them into an abutting relationship with each other. The deflation devices 1022, accordingly, all can be arranged substantially perpendicularly to the direction of a vehicle's travel and with minimal to no gaps between them, thereby enhancing the effectiveness of the deflation devices 1022.

Figure 26B:
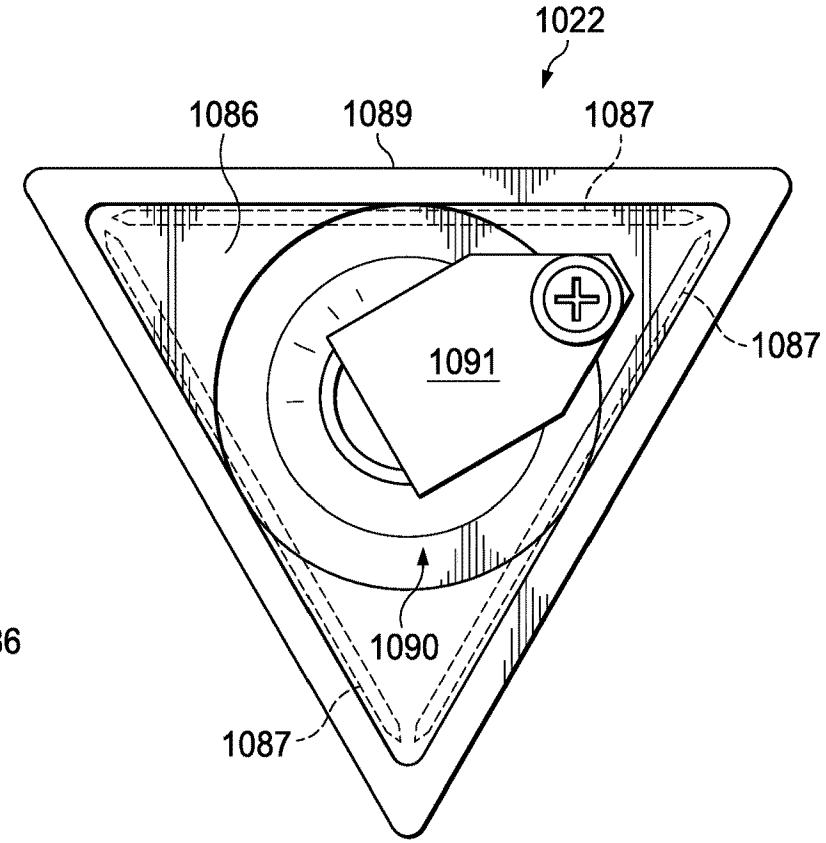
FIGS. 26A and 26B are end views depicting opposite ends of one of the deflation devices of FIG. 18.
Figure 26A:
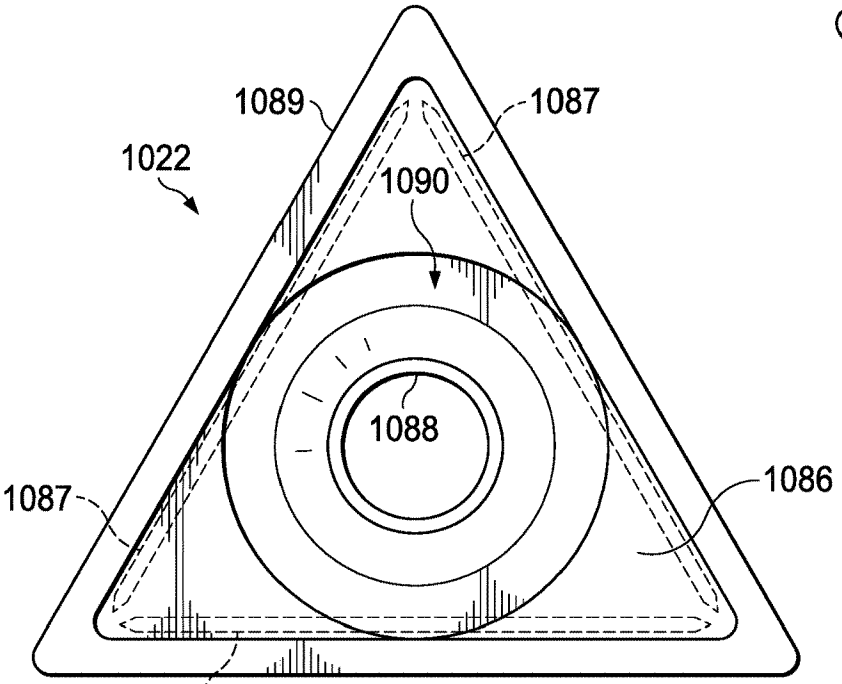
Figure 27:
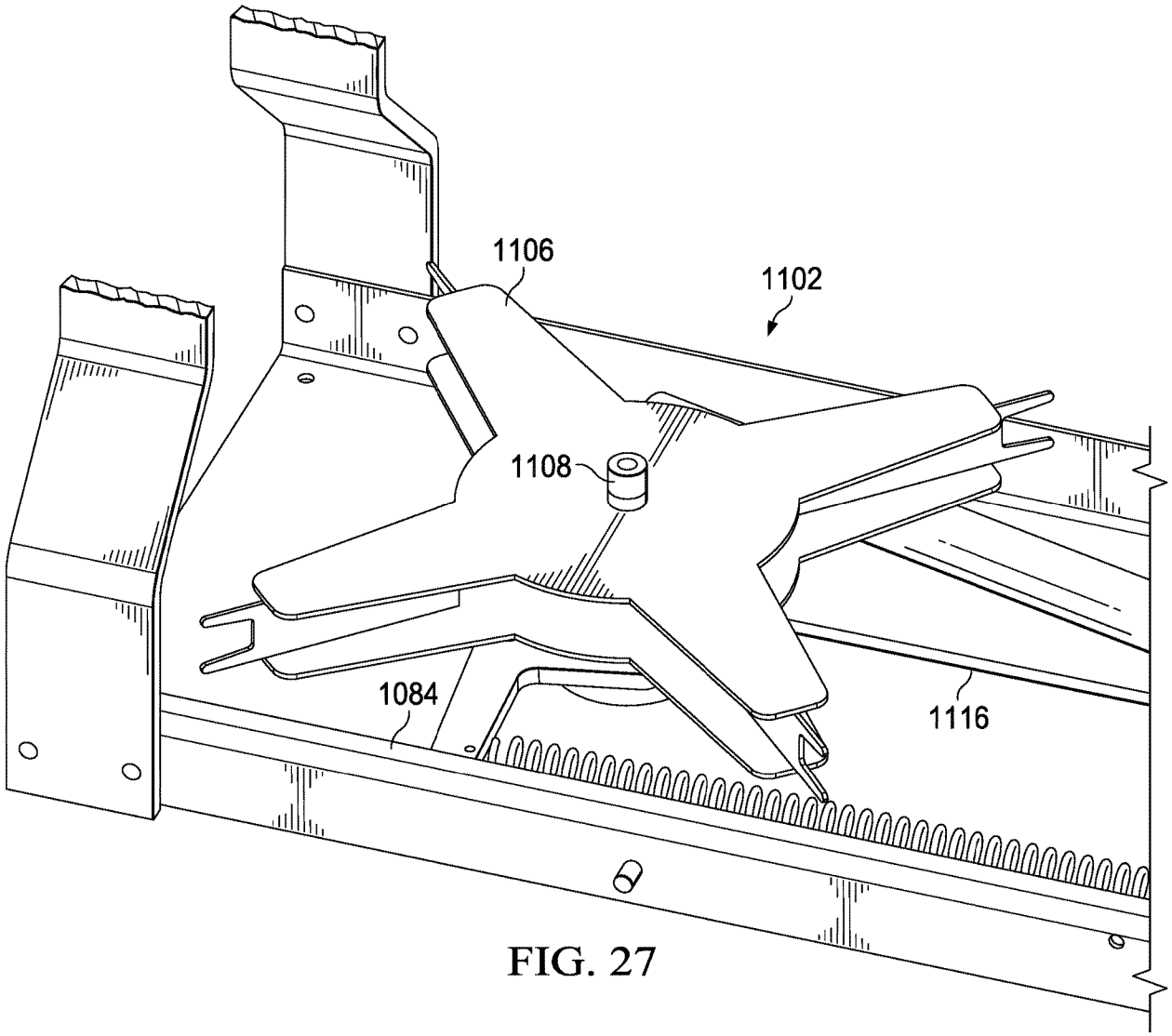
FIGS. 27-28 are enlarged isometric views depicting the spool of FIG. 18 in association with various other components.
Figure 28:
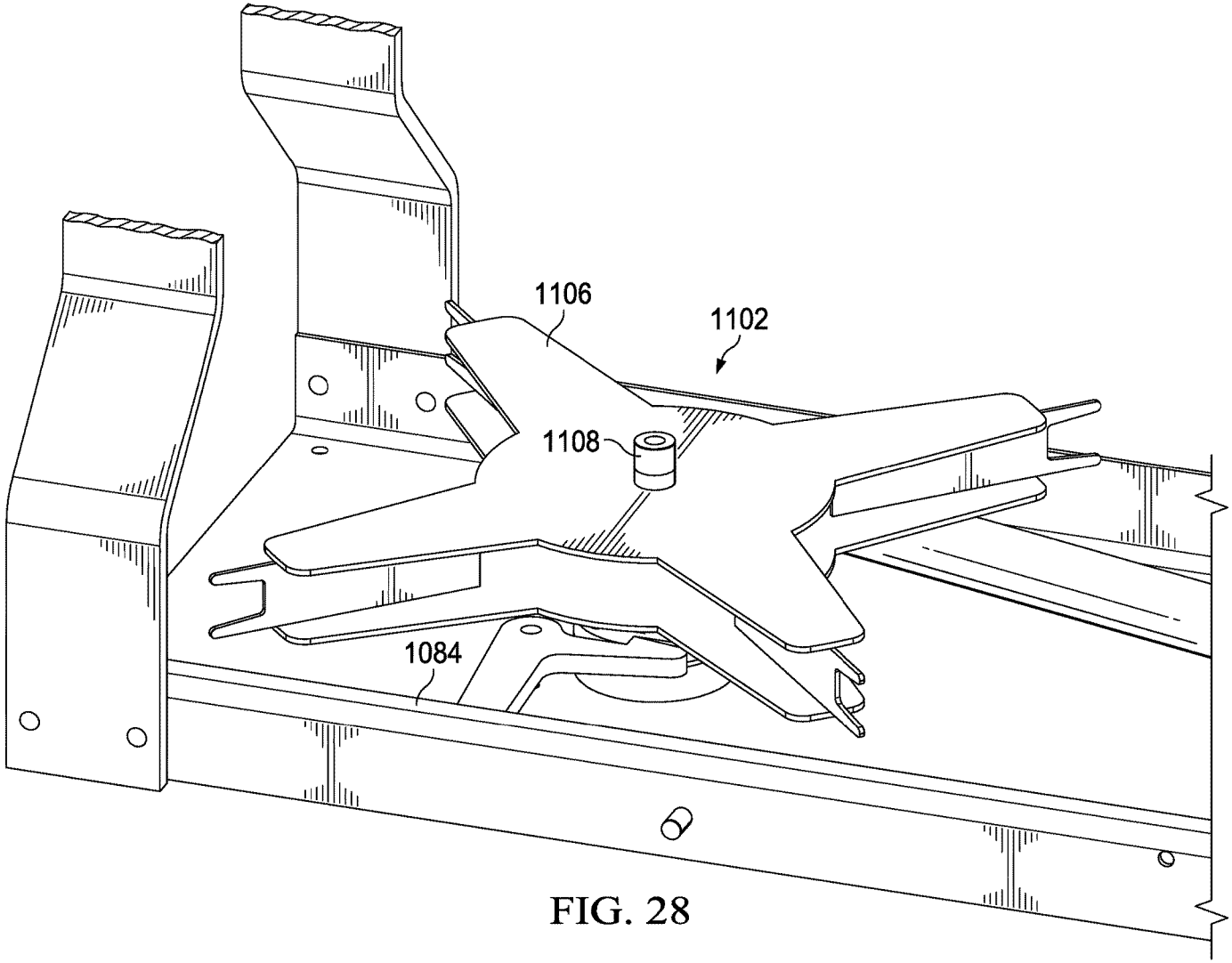

The deflation devices 1022 can be configured to permit routing of the tether 1176 therethrough. Referring now to FIGS. 26A and 26B, opposing ends of one of the deflation devices 1022 are illustrated. The deflation device 1022 can include a body 1086 that defines a central passageway 1088 that extends the entire length of the deflation device 1022. The internal spikes 1087 of the deflation device 1022 can be disposed between the central passageway 1088 and an outer wall 1089 such that the internal spikes still perform appropriately when the deflation devices 1022 encounter a vehicular tire. The central passageway 1088 can have a tapered opening 1090 both ends. The tapered opening 1090 can have a greater circumference than the central passageway 1088. The circumference of the tapered opening 1090 can narrow as it extends towards the central passageway 1088. In one embodiment, the tapered opening 1090 can be about one inch in length. The tapered opening 1090 can enhance the alignment and gathering of the deflation devices 1022 into an abutted aligned relationship when deployed. The tapered opening 1090 and central passageway 1088 can provide a friction-free/anti-snag path for the tether 1176 thereby facilitating effective alignment and trajectory of the deflation devices during the flight sequence of the deployment cycle.

A self-latching flap member 1091 ("the flap member") can be provided on one end of the inflation device 1022 and can be configured to prevent the tether 1176 from being pulled through the inflation device 1022 in one direction. The flap member 1091 can be formed of an elastomeric material, or other suitable flexible material. When the deflation device 1022 is launched from the propulsion unit 1020, the deflation device 1022 can slide along the tether 1186 such that the tether 1186 is pulled out of the tapered opening 1090 associated with the flap member 1091. The tether 1186 can urge the flap member 1091 away from the tapered opening 1090 to allow for pulling of the tether 1186 out of the tapered opening 1090. When the deflation device 1022 is to be returned to the propulsion unit 1020, a retractor cable (1109 in FIG. 33) attached to the tether 1186 can pull on the tether 1186 in such a manner that the tether 1186 is urged into the tapered opening 1090, as will be described below. Pulling of the tether 1186 is this direction can urge the flap member 1091 towards the tapered opening 1090 which can pinch the tether 1186 between the central passageway 1088 and the flap member 1091 thereby preventing the deflation device 1022 from sliding along the tether 1186. As such, the deflation device 1022 can be pulled to the propulsion unit 1020 while preventing the tether 1186 to be pulled through the deflation device 1022.

It is to be understood that all of the deflation devices 1022 used with the propulsion unit 1020, can be similar to, or the same in many respects as, the deflation device 1022 illustrated in FIGS. 26A and 26B. In one embodiment, the flap member 1091 is only provided on the end of the deflation device that is most proximate to the launcher (e.g., end 2013 in FIG. 36) when the deflation devices 1022 are deployed to a target.

Referring now to FIGS. 18, 19, and 27-33, a retraction assembly 1100 can be associated with the support base 1084 and configured to facilitate the return of the deflation devices 1022 to the support base 1084 once they have been deployed to a target and, in most cases, engaged with a vehicle. More particularly, and as will be described in further detail below, once the deflation devices 1022 have been deployed to a roadway or other target and gathered together by the tether 1176, the retraction assembly 1100 can be actuated (after the deflation devices 1022 have engaged with a vehicle or are no longer needed) to pull the deflation devices 1022 away from the roadway and to a location more proximate to the support base 1084 for collection by a user. The retraction assembly 1100 can accordingly prevent a user from entering a roadway or other target to collect the deflation devices 1022.

The retraction assembly 1100 can include a spooling assembly 1102 and a linear actuator 1104. As illustrated in FIGS. 18, 19, and 27-29, the spooling assembly 1102 can include a spool 1106 that is rotatably coupled with the support base 1084 by a spindle 1108. In one embodiment, the spool 1106 can be journalled with respect to the spindle 1108 by a bearing (not shown). The retractor cable (1109 in FIG. 33) can be wound around the spool 1106 and coupled with to the tether 1176 with a ring (1111 in FIG. 24). As will be described in further detail below, when the deflation devices 1022 are deployed, the spool 1106 can be free to rotate (e.g., in a clockwise direction) to allow the retractor cable 1109 to be dispensed along with the deflation devices 1022.

The linear actuator 1104 can be pivotally coupled at a proximal end 1110 to the support base 1084. A pulley member 1112 can be rotatably coupled to a distal end 1114 of the linear actuator 1104. A spooling cable 1116 can be coupled with the support base 1084 (on an opposing side of the support base 1084 from the proximal end 1110 of the linear actuator 1104), routed over the pulley member 1112, and around a lower pulley 1118 (FIGS. 30-32) of the spindle 1108.

Figure 30:
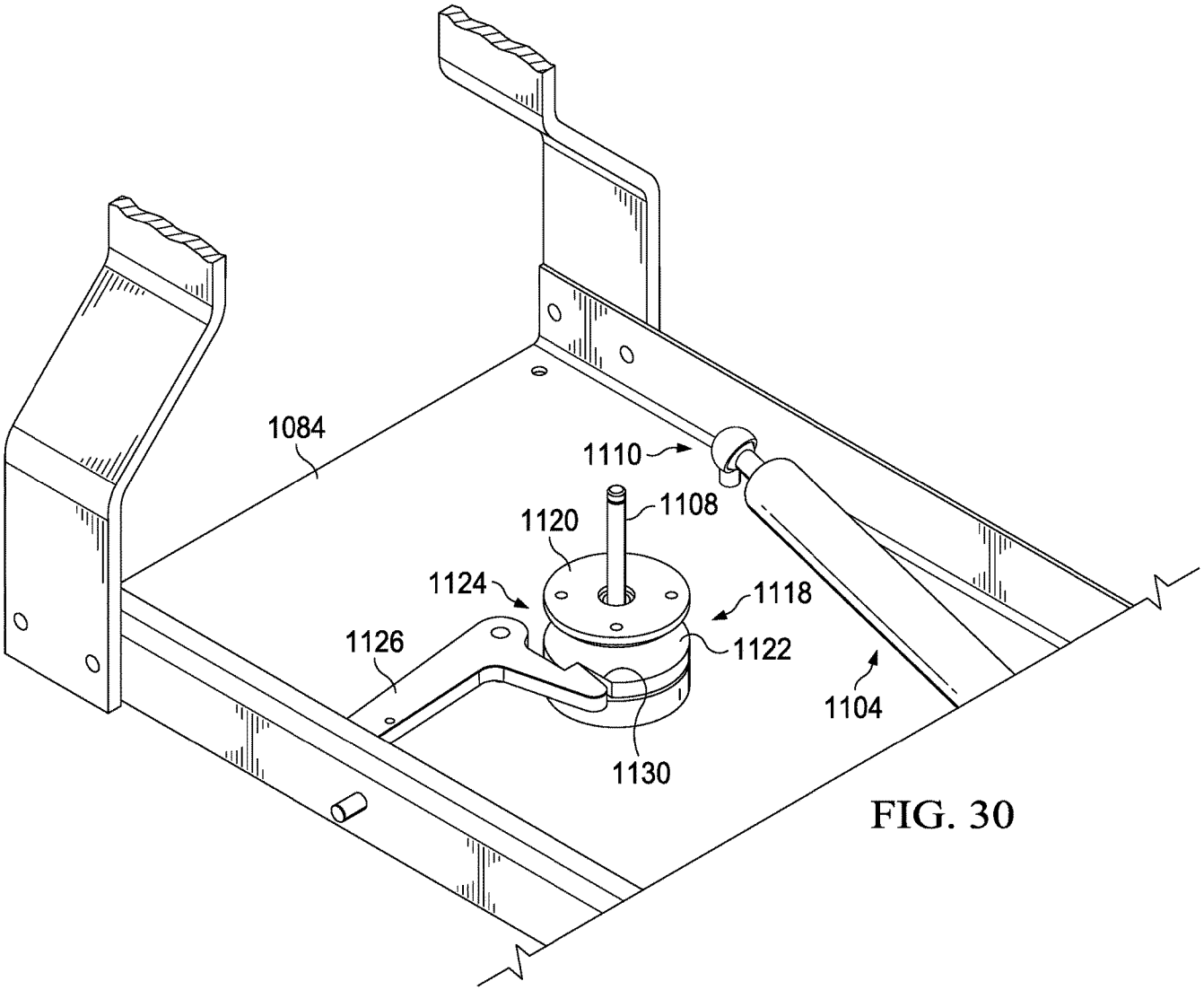
FIGS. 30-31 are various views of a portion of the retraction assembly of FIG. 29 with various components removed for clarity of illustration.
Figure 31:
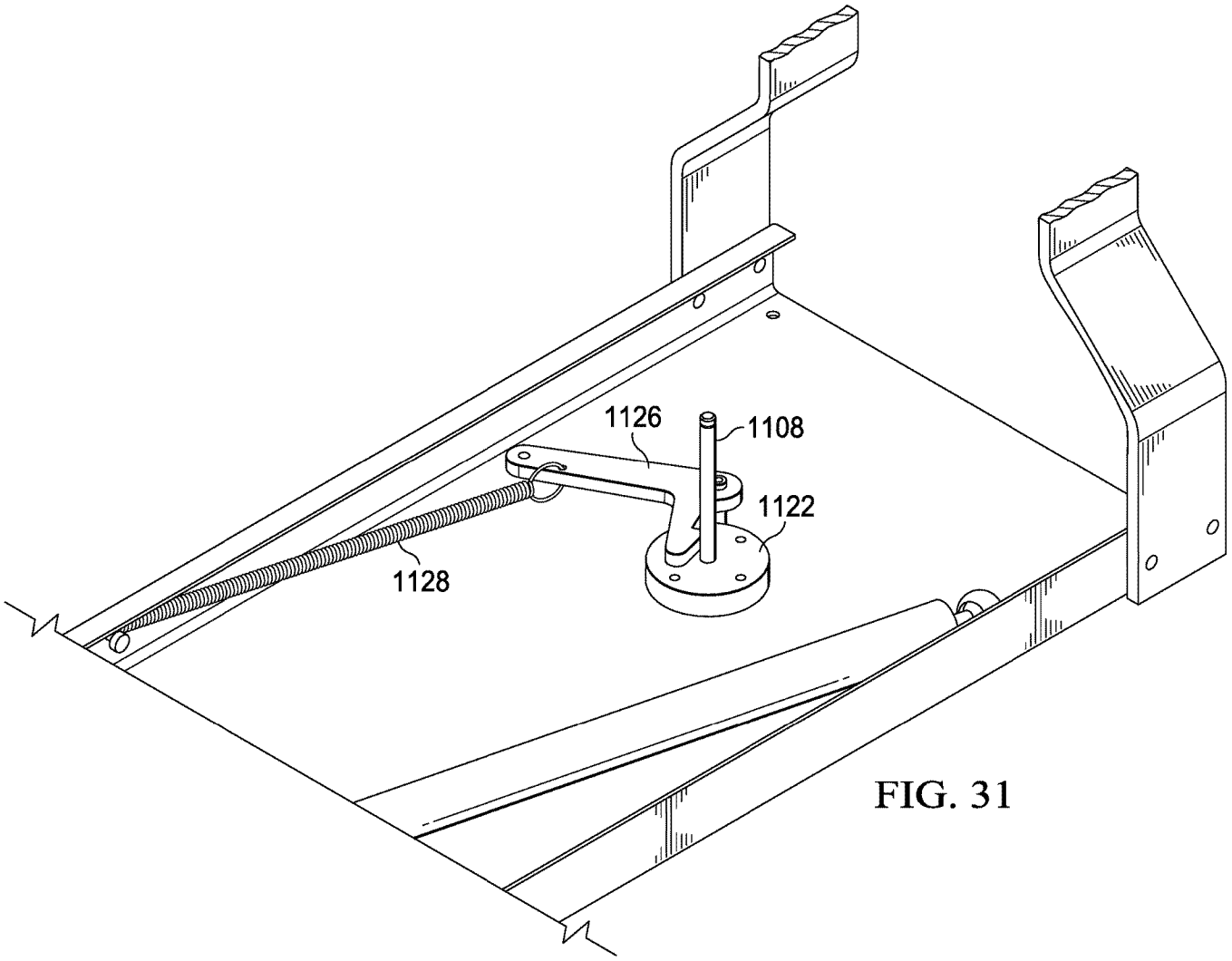

Referring now to FIGS. 30-31, the lower pulley 1118 can include an upper collar 1120 and a lower collar 1122 that are coupled together and spaced apart to define a channel 1124 for receiving the spooling cable 1116. The upper collar 1120 can be coupled with the spool 1106 such as with releasable fasteners (not shown). The lower pulley 1118 can be rotatably coupled with the spindle 1108. In one embodiment, the lower pulley 1118 can be journalled with respect to the spindle 1108 by a bearing (not shown).

Figure 25A:
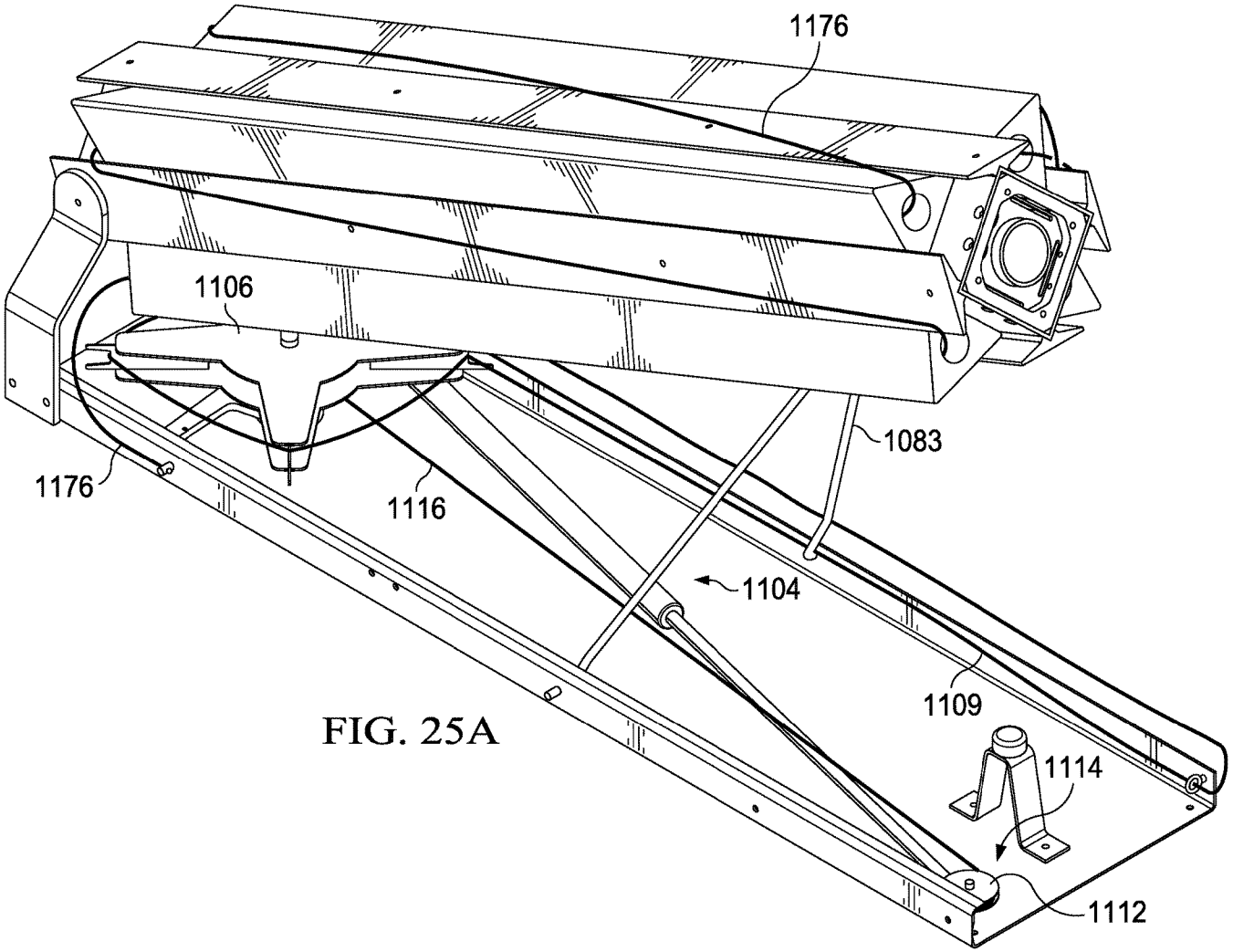
Figure 25B:
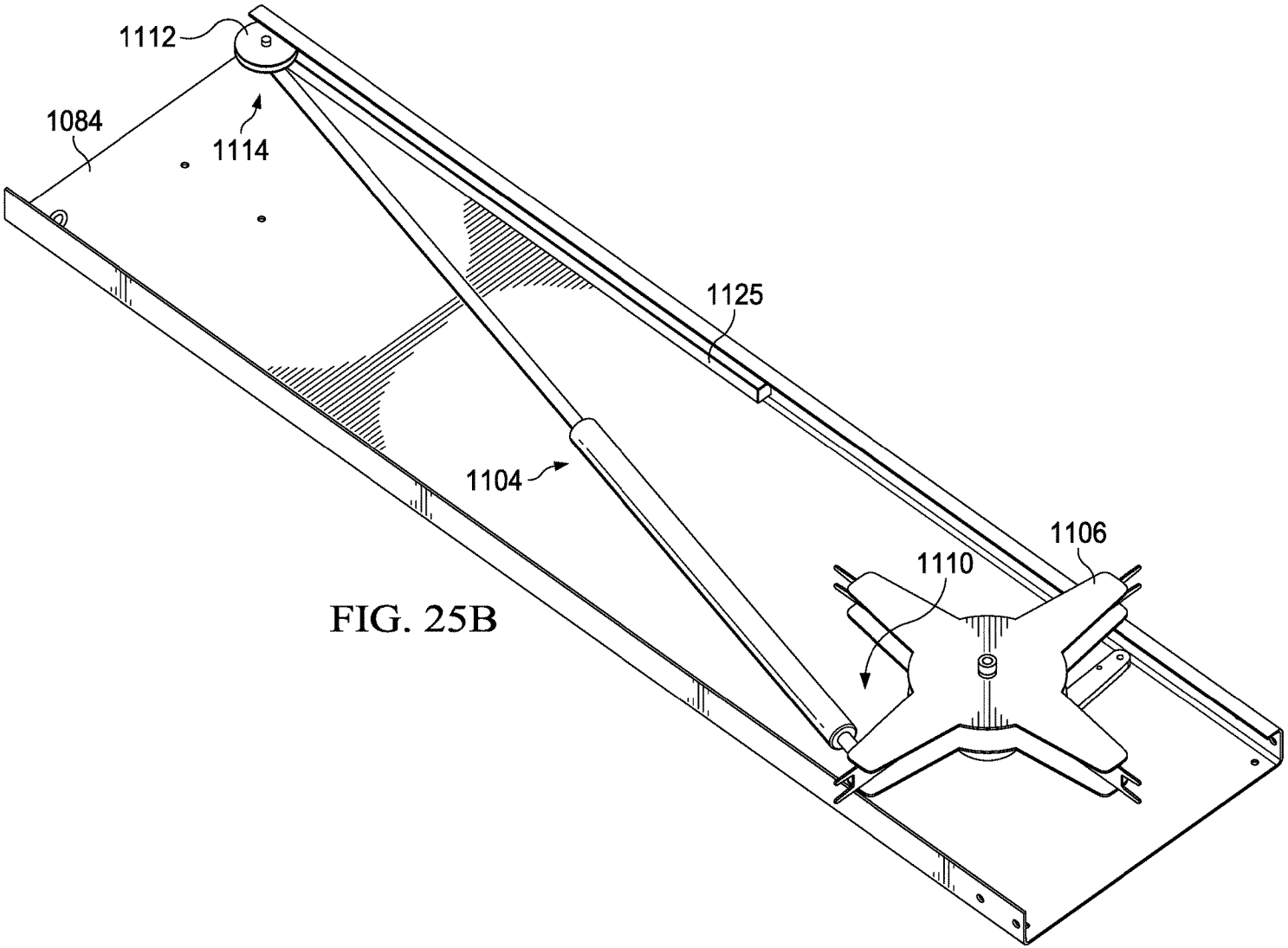
FIG. 25B is an isometric view of the propulsion unit of FIG. 18, with a canister removed for clarity of illustration.
Figure 29:
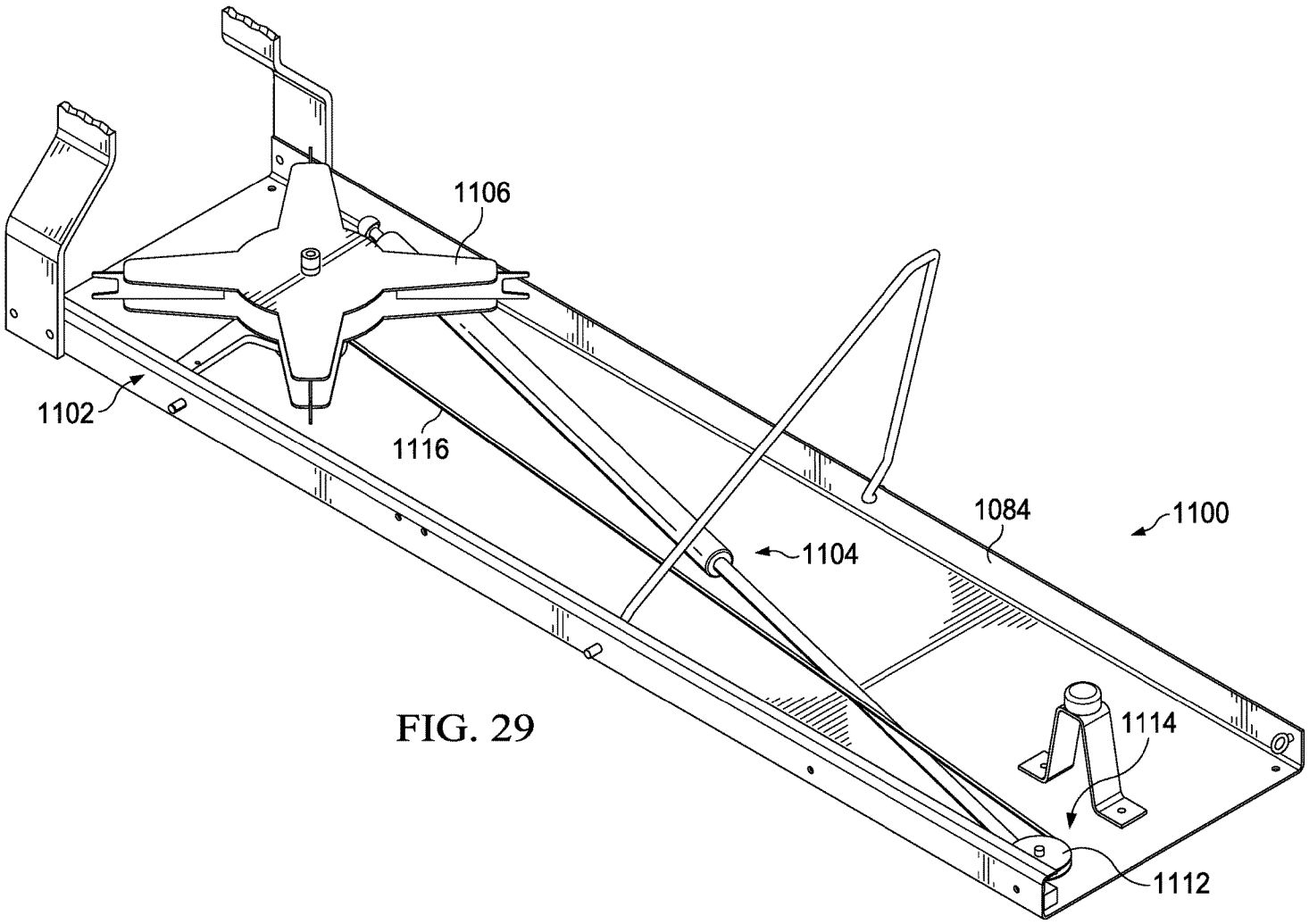
FIG. 29 is an enlarged isometric view depicting a retraction assembly of the propulsion unit of FIG. 18 in association with various other components.
Figure 32:
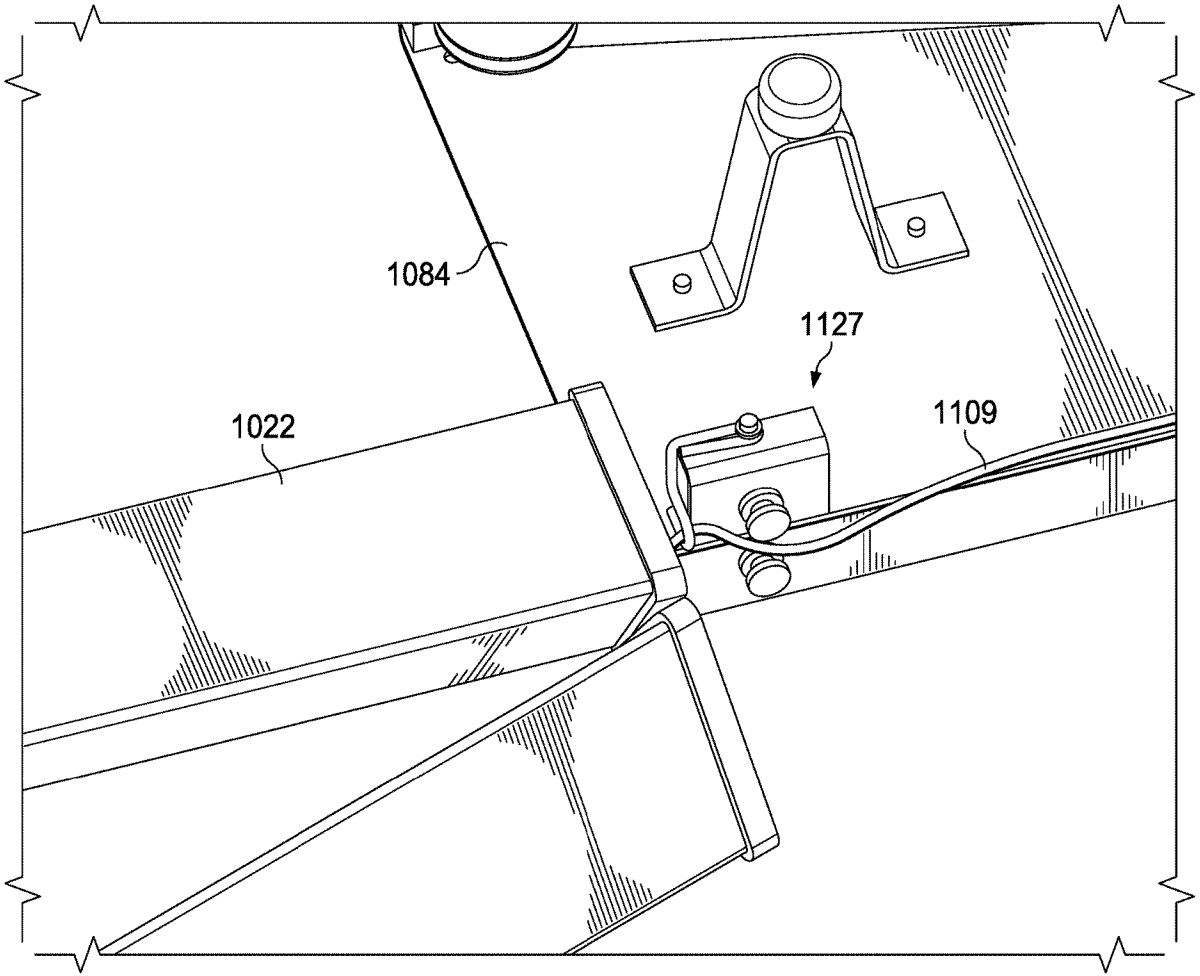
FIG. 32 is an enlarged isometric view depicting one example of a guide member for the retraction assembly illustrated in FIG. 29.
Figure 33:
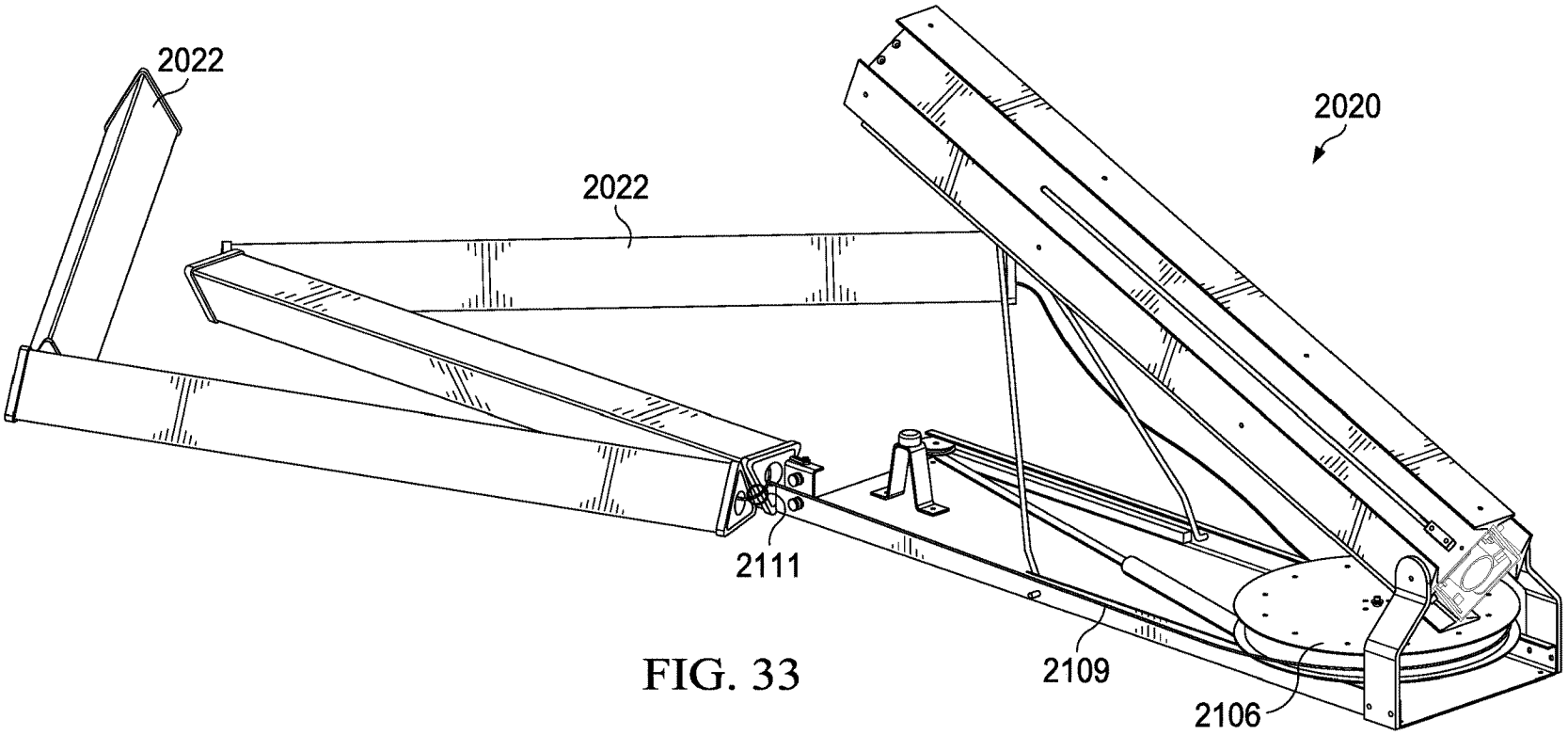
FIGS. 33-36 are various views depicting a propulsion unit and a plurality of deflation devices, in accordance with yet another embodiment.
Figure 34:
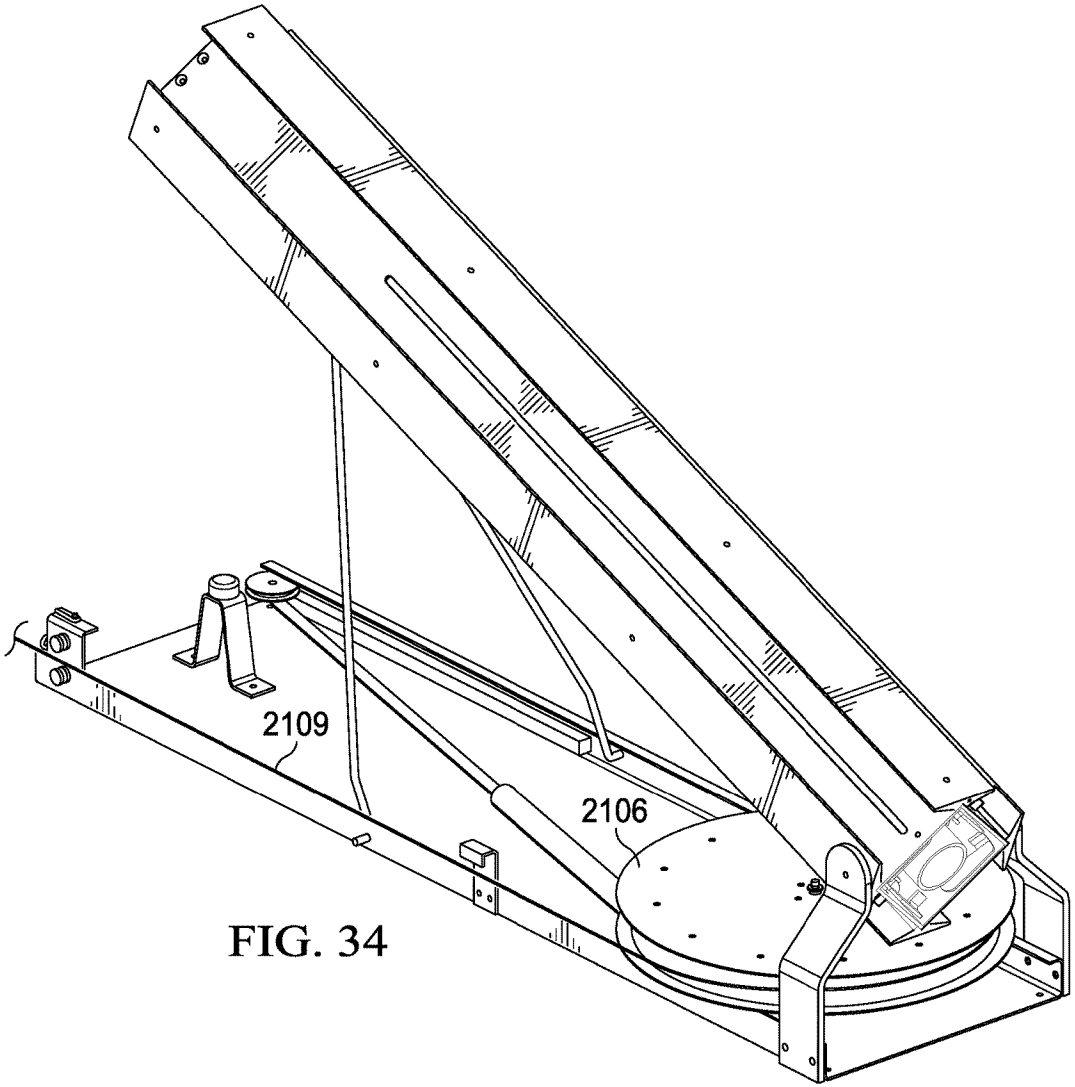
Figure 35:
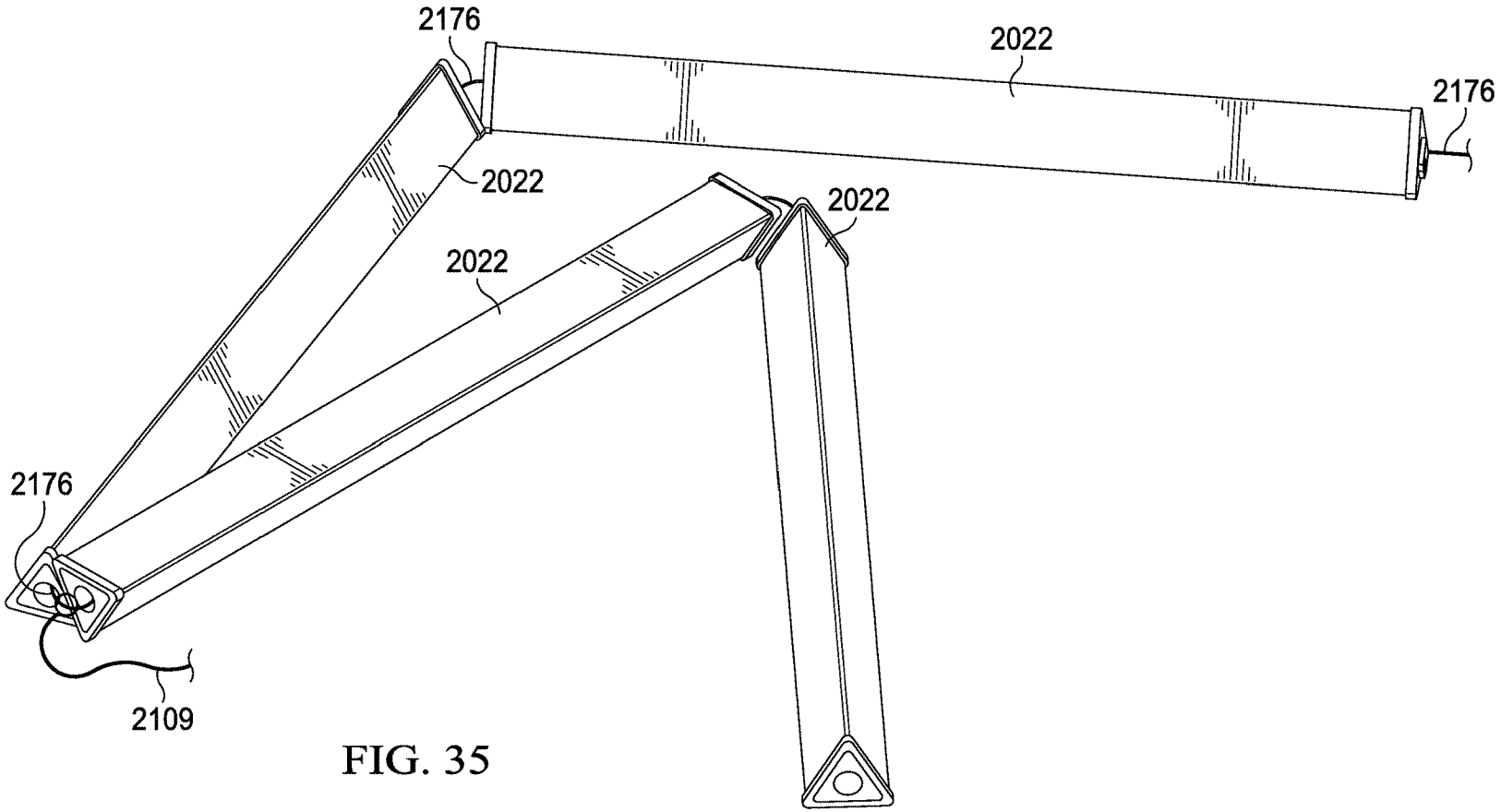
Figure 36:
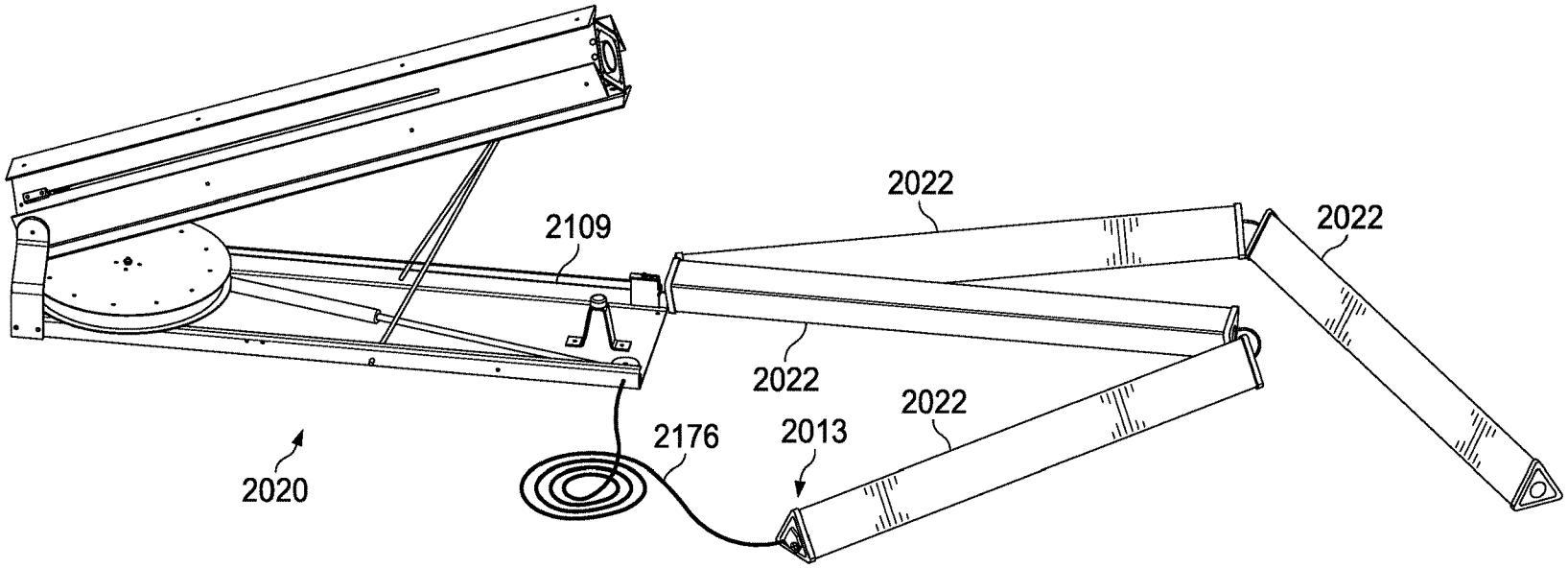

The linear actuator 1104 can be selectively extendible between a retracted position (not shown) and an extended position (as illustrated in FIG. 29). When the linear actuator 1104 is in the retracted position, the pulley member 1112 can be more proximate the spooling assembly 1102 than when in the extended position. The spooling cable 1116 can be wound around the lower pulley 1118 in an opposite direction from the direction that the retractor cable 1109 is wound on the spool 1106. As such, when the linear actuator 1104 moves from the retracted position to the extended position, the pulley member 1112 can push the spooling cable 1116 away from the lower pulley 1118 thus causing the spool 1106 to rotate in a direction that causes the retractor cable 1109 to be gathered on the spool 1106, thereby pulling the deflation devices 1022 towards the support base 1084 and away from the roadway or other target. As illustrated in FIG. 25B, the pulley member 1112 can ride along a guide rail 1125. In one embodiment, as illustrated in FIG. 32, a guide member 1127 can be attached to the support base 1084 and configured to guide the retractor cable 1109 during dispensation and retraction of the retractor cable 1109 from/to the spool 1106.

Referring now to FIGS. 30-31, a latch 1126 can be provided that is pivotally coupled with the support base 1084 and configured to cooperate with the lower collar 1122 to allow the spool 1106 and the lower pulley 1118 to rotate in a clockwise direction (when viewed from above the support base 1084) and to lock the spool 1106 and the lower pulley 1118 in place to prevent them from rotating in a counterclockwise direction. The latch 1126 can be biased into contact with the lower collar 1122 by a spring 1128 (FIG. 31). When the spool 1106 and the lower pulley 1118 are rotated in a clockwise direction, the latch 1126 is free to ride along the lower collar 1122 of the lower pulley 1118. But when the spool 1106 and the lower pulley 1118 are rotated in a counterclockwise direction, the latch 1126 can be biased into engagement with a notch 1130 of the lower collar 1122 to prevent the spool 1106 and the lower pulley 1118 from further rotation.

When the deflation devices 1022 are deployed, the spool 1106 can be free to rotate (e.g., in a clockwise direction) to allow the retractor cable 1109 to be dispensed along with the deflation devices 1022. Once the deflation devices 1022 have been gathered together by the tether 1176, the latch 1126 can be pivoted away from the lower collar 1122 (after the deflation devices 1022 have engaged with a vehicle or are no longer needed) to release the spool 1106 and the lower pulley 1118. In response, the linear actuator 1104 can move from the retracted position to the extended position, thereby pushing the spooling cable 1116 away from the lower pulley 1118 and rotating the spool 1106. The retractor cable 1109 can be gathered onto the spool 1106 which can pull the deflation devices 1022 towards the support base 1084 and away from the roadway or other target. The ring 1111 can be disposed between adjacent deflation devices 1022 such that two of the deflation devices reside on either side of the ring 1111 similar to the arrangement illustrated in FIG. 17. When the retractor cable 1109 pulls the tether 1186, the flap member 1091 can prevent the tether 1186 from pulling through the two inflation devices 1022 disposed between the ring 1111 and the propulsion assembly 1022. As such, all of the deflation devices 1022 remain secured to the tether 1186 during retraction by the retractor cable 1109. In one embodiment, the latch 1126 can be manually pivoted away from the lower collar 1122, while in other embodiments, the latch 1126 can be electronically pivoted away from the lower collar 1122 such as with a solenoid, for example.

It will be appreciated that the propulsion unit 1020 can facilitate automated deployment, alignment, and retraction of the deflation devices 1022 with respect to a roadway. For example, when a user arrives at the roadway, the propulsion unit 1020 can be stored in the trunk or other location of the vehicle. The user can retrieve the propulsion unit 1020 from the vehicle and can place it on the ground adjacent to the roadway. The user can then pivot the propulsion unit 1020 with respect to the support base 1084 from the stored position into the deployed position. Once the propulsion unit 1020 is in position and the deflation devices 1022 are ready to be deployed, the user can actuate the latching mechanism 1078 (e.g., mechanically or electrically) which can sequentially deploy the deflation devices 1022 to the roadway. As the deflation devices 1022 are being deployed, the spool 1106 can rotate to dispense the retractor cable 1109 together with the deflation devices 1022. Once the deflation devices 1022 reach the target, the tether 1176 can retract the deflation devices 1022 slightly and enough to align them and bring them into an abutting relationship with each other. Once the deflation devices 1022 have engaged with a vehicle and/or are no longer needed, the latch 1126 can be actuated which can release the spool 1106 and the lower pulley 1118. The linear actuator 1104 can accordingly extend from the retracted position to the extended position, thereby pushing the spooling cable 1116 away from the lower pulley 1118 and rotating the spool 1106. As a result, the retractor cable 1109 can be gathered onto the spool 1106 to pull the deflation devices 1022 towards the support base 1084 and away from the roadway. Once the deflation devices 1022 have been pulled from the roadway, the user can gather the deflation devices 1022 and return the propulsion unit 1020 to the vehicle. The propulsion unit 1020 can accordingly allow for deployment and removal of the deflation devices 1022 without requiring a user to enter the roadway.

FIGS. 33-36 illustrate a propulsion unit 2020 according to another embodiment. The propulsion unit 2020 can be similar to, or the same as, in many respects as the propulsion unit 1020 of FIGS. 18-33. For example, the propulsion unit 2020 can include a retractor cable 2109 that is wound about a spool 2106 and attached to a plurality of tire deflation devices 2022. A tether 2176 can be routed through each of the tire deflation devices 2022 and coupled to a retractor cable 2109 by a ring 2111. However, the spool 2106 is substantially disc-shaped.

Figure 37:
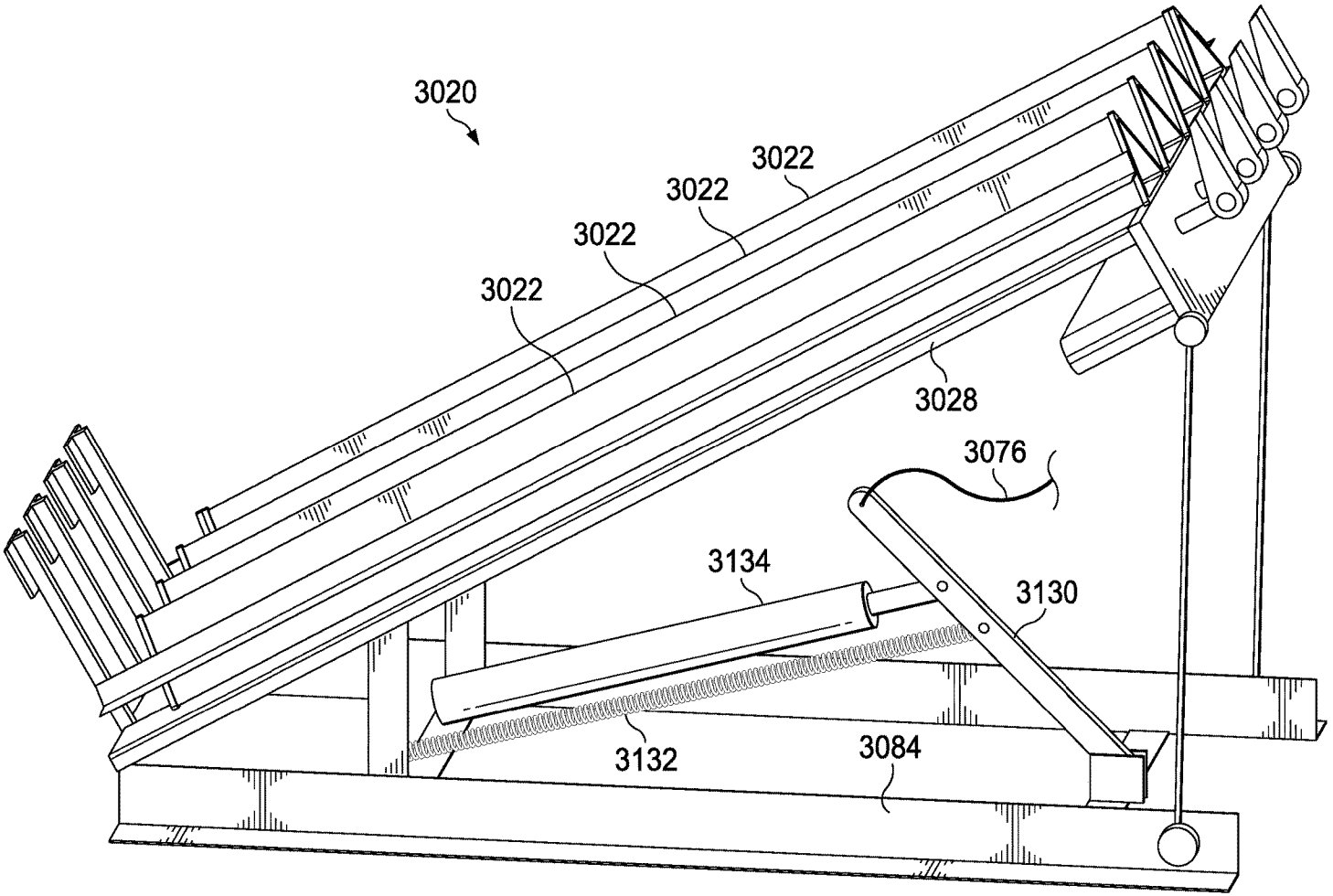
FIGS. 37-38 are various views depicting a propulsion unit and a plurality of deflation devices, in accordance with still yet another embodiment.
Figure 38:
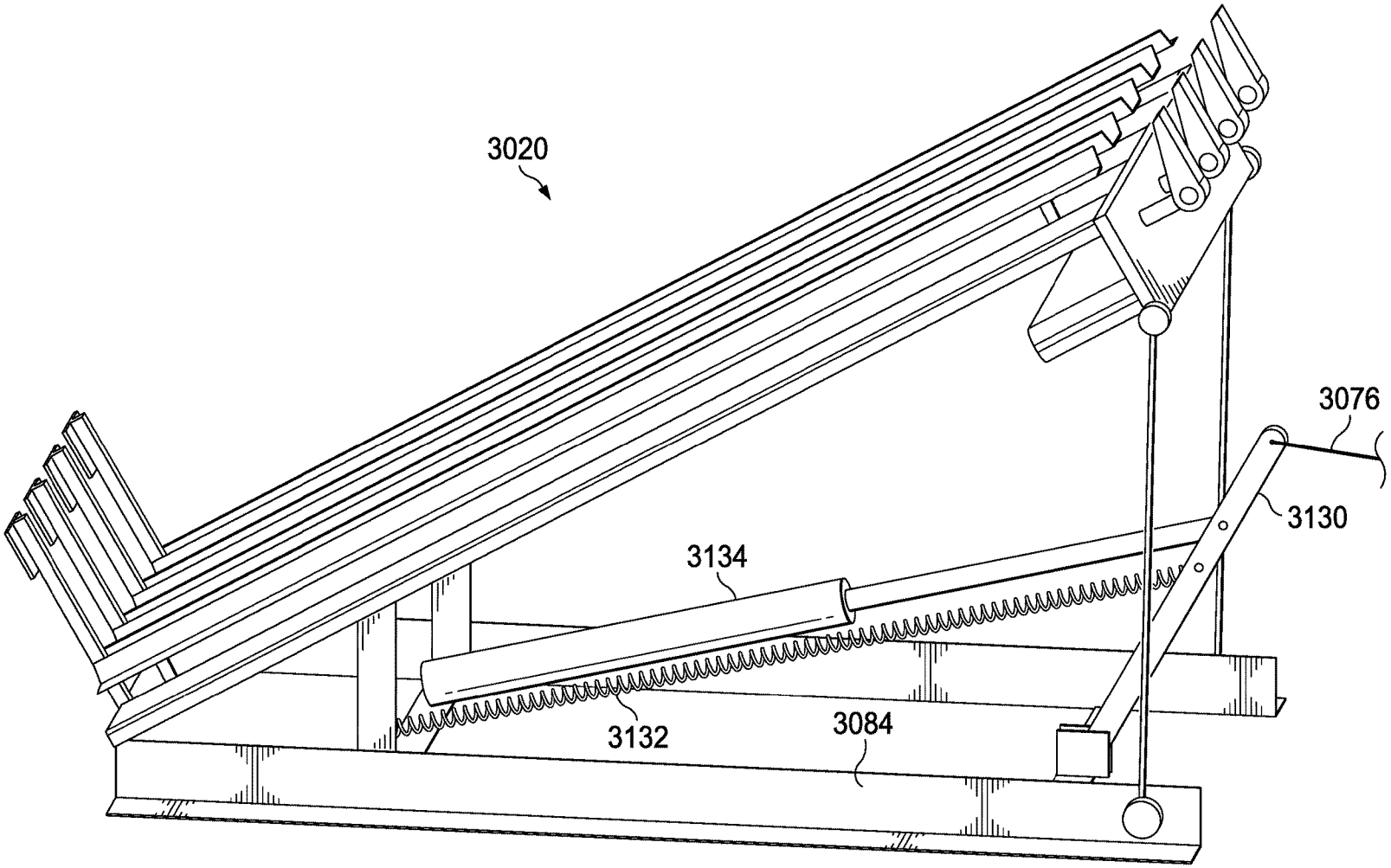

FIGS. 37 and 38 illustrate a propulsion unit 3020 according to another embodiment. The propulsion unit 3020 can be similar to, or the same as, in many respects as the propulsion units 1020 and 2020 of FIGS. 18-32 and 33-36, respectively. For example, the propulsion unit 3020 can include a base 3028 for supporting a plurality of tire deflation devices 3022 that are attached with a tether 3076. However, the propulsion unit 3020 can include a pivotal retractor member 3130 to which the tether 3076 is attached. The tether 3076 can be formed of an inelastic material such as steel. The pivotal retractor member 3130 can be pivotally coupled with a support base 3084 and pivotable between a retracted position (FIG. 37) and an extended position (FIG. 38). A spring 3132 and a pneumatic damper 3134 can be coupled with each of the support base 3084 and the pivotal retractor member 3130. When the deflation devices 3022 are deployed, the pivotal retractor member 3130 can be pulled into the extended position by the tether 3076. The spring 3132 can pull the pivotal retractor member 3130 back to the retracted position to align the deflation devices 3022 and provide them in an abutting relationship. The pneumatic damper 3134 can slow the pull of the pivotal retractor member 3130 back to the retracted position to prevent sudden pulling of the deflation devices 3022 thus disrupting the alignment and/or abutting relationship.

The foregoing description of embodiments and examples of the disclosure has been presented for purposes of illustration and description. It is not intended to be exhaustive or to limit the disclosure to the forms described. Numerous modifications are possible in light of the above teachings. Some of those modifications have been discussed and others will be understood by those skilled in the art. The embodiments were chosen and described in order to best illustrate the principles of the disclosure and various embodiments as are suited to the particular use contemplated. The scope of the disclosure is, of course, not limited to the examples or embodiments set forth herein, but can be employed in any number of applications and equivalent devices by those of ordinary skill in the art. Rather it is hereby intended the scope of the invention be defined by the claims appended hereto. Also, for any methods claimed and/or described, regardless of whether the method is described in conjunction with a flow diagram, it should be understood that unless otherwise specified or required by context, any explicit or implicit ordering of steps performed in the execution of a method does not imply that those steps must be performed in the order presented and may be performed in a different order or in parallel.

What is claimed is:

1. A tire deflation device comprising:

a body having an outer wall that defines a passageway that is substantially elongated; and a plurality of internal spikes disposed between the outer wall and the passageway such that each internal spike of the plurality of internal spikes is isolated from the passageway;

wherein the passageway is configured to facilitate routing of a tether of a propulsion unit therethrough without contacting the plurality of internal spikes.

2. The tire deflation device of claim 1 wherein the passageway defines at least one tapered opening.

3. The tire deflation device of claim 1 wherein the passageway comprises a central passageway.

4. The tire deflation device of claim 1 wherein the passageway extends along the entire length of the body.

5. The tire deflation device of claim 1 further comprising a flap member provided on one end of the body and extending over at least a portion of the passageway.

6. The tire deflation device of claim 5 wherein the flap member is formed of an elastomeric material.

7. An apparatus comprising:

a first tire deflation device and a second tire deflation device, the first tire deflation device and the second tire deflation device each comprising:

a body having an outer wall that defines a passageway that is substantially elongated; and a plurality of internal spikes disposed between the outer wall and the passageway such that each internal spike of the plurality of internal spikes is isolated from the passageway; and a tether routed through the passageway of each of the first tire deflation device and the tire deflation device, wherein the tether is coupled with a distal end of the first tire deflation device, and the second tire deflation device is configured to slide with respect to the tether.

8. The apparatus of claim 7 wherein the passageway of at least one of the first tire deflation device and the second tire deflation device defines a tapered opening located at one end of the body.

9. The apparatus of claim 7 wherein the passageway of at least one of the first tire deflation device and the second tire deflation device comprises a central passageway.

10. The apparatus of claim 7 wherein the passageway of at least one of the first tire deflation device and the second tire deflation device extends along the entire length of the body.

11. The apparatus of claim 7 further comprising a flap member provided on one end of the body of the second tire deflation device and extending over at least a portion of the passageway.

12. The apparatus of claim 11 wherein the flap member is formed of an elastomeric material.

* * * * *